US008232949B2

(12) United States Patent
Kimura

(10) Patent No.: US 8,232,949 B2
(45) Date of Patent: Jul. 31, 2012

(54) LIQUID CRYSTAL DISPLAY DEVICE, DRIVING CONTROL CIRCUIT AND DRIVING METHOD USED IN SAME

(75) Inventor: Hiroaki Kimura, Kanagawa (JP)

(73) Assignee: NLT Technologies, Ltd., Kawasaki (JP)

( * ) Notice: Subject to any disclaimer, the term of this patent is extended or adjusted under 35 U.S.C. 154(b) by 753 days.

(21) Appl. No.: 11/693,541

(22) Filed: Mar. 29, 2007

(65) Prior Publication Data

US 2007/0229432 A1 Oct. 4, 2007

(30) Foreign Application Priority Data

Mar. 31, 2006 (JP) ..... 2006-101252
Jun. 7, 2006 (JP) ..... 2006-159001

(51) Int. Cl.
*G09G 3/36* (2006.01)

(52) U.S. Cl. ..... 345/96; 345/98; 345/100; 345/209; 345/204

(58) Field of Classification Search ..... 345/87–104, 345/208–210, 204
See application file for complete search history.

(56) References Cited

U.S. PATENT DOCUMENTS

| | | | | |
|---|---|---|---|---|
| 7,161,576 | B2 * | 1/2007 | Kawabe et al. | 345/99 |
| 2004/0183768 | A1 * | 9/2004 | Yamato et al. | 345/98 |

FOREIGN PATENT DOCUMENTS

| | | | |
|---|---|---|---|
| JP | 01-124898 | A | 5/1989 |
| JP | 03-172085 | A | 7/1991 |
| JP | 04-044478 | A | 2/1992 |
| JP | 04-088770 | A | 3/1992 |
| JP | 2002-132220 | A | 5/2002 |
| JP | 2003-186454 | A | 7/2003 |
| JP | 2003-255915 | A | 9/2003 |
| JP | 2003-280600 | A | 10/2003 |

* cited by examiner

*Primary Examiner* — Lun-Yi Lao
*Assistant Examiner* — Kelly B Hegarty
(74) *Attorney, Agent, or Firm* — Sughrue Mion, PLLC

(57) ABSTRACT

A liquid crystal display device is provided which is capable of improving quality of moving images. A field dividing driving operation is performed in which an odd field during which each of scanning electrodes in odd-numbered rows is sequentially driven and an even field during which each of scanning electrodes in even-numbered rows is sequentially driven occur, alternately and repeatedly, with time width of a refresh rate. In the former half of the odd field, display data is written in each of pixel regions corresponding to scanning electrodes in odd-numbered rows and, in the latter half of the odd field, black data is written in each of the pixel regions corresponding to scanning electrodes in the odd-numbered rows. In the former half of the even field, display data is written in each of pixel regions corresponding to scanning electrodes in the even-numbered rows and, in the latter half of the even field, black data is written in each of pixel regions corresponding to scanning electrodes in the even-numbered rows.

15 Claims, 21 Drawing Sheets

LIQUID CRYSTAL DISPLAY DEVICE, DRIVING CONTROL CIRCUIT AND DRIVING METHOD USED IN SAME

BACKGROUND OF THE INVENTION

1. Field of the Invention

The present invention relates to a liquid crystal display device and to a driving control circuit and driving method to be used in the liquid crystal display, and more particularly to the liquid crystal display device suitably used for displaying moving images and to the driving control circuit and driving method to be used in the liquid crystal display device.

The present application claims priorities of Japanese Patent Application Nos. 2006-101252 filed on Mar. 31, 2006 and 2006-159001 filed on Jun. 7, 2006, which are hereby incorporated by reference.

2. Description of the Related Art

In recent years, a liquid crystal display device is used not only as a monitor of personal computers but also as a display for television sets or a like. In its application to television sets, performance of displaying moving images is required. However, in conventional liquid crystal displays, when moving images are displayed, while a current image remains persistent in a user's consciousness, a subsequent image is displayed, which causes an afterimage (trail-leaving and/or blurring of moving images) to be seen by users. The reason for this is that much time is required for a response to a voltage applied to the liquid crystal and holding-type driving is performed in which a current frame is held until a display signal corresponding to a succeeding frame is supplied.

A trail-leaving phenomenon caused by the response speed of a liquid crystal can be reduced by increasing the response speed of the liquid crystal by performing an overdriving operation in which an over voltage is applied to the liquid crystal. Also, a trail-leaving phenomenon caused by holding-type driving can be reduced by using an impulse driving method in which an image is displayed only for a moment as in the case of a CRT (Cathode Ray Tube) display device. The impulse driving method includes, for example, a black insertion driving method in which a black image is displayed after displaying of an image on a liquid crystal display panel during one frame period. The impulse driving method also includes another method (backlight blinking method) in which a backlight is turned on after the application of a specified voltage to an image region.

The conventional liquid crystal display device of the type, described above and shown in FIG. 18, includes a black insertion driving control section 1, a source driver 2, a gate driver 3, and a liquid crystal display panel 4. The liquid crystal display panel 4 has a plurality of rows of scanning electrodes (not shown), a plurality of columns of data electrodes (not shown) and a plurality of pixel regions, in which a scanning signal "OUT" is successively applied to each of the scanning electrodes and corresponding display data D is fed to each of the data electrodes and the corresponding display data D is written into each of pixel regions and control is exerted on light from a backlight (not shown) in a manner to correspond to each display data D. The black insertion driving control section 1 sends out, in response to an input video signal VD, a control signal "a" to the source driver 2 and a control signal "b" to the gate driver 3. The source driver 2 applies, in response to the control signal "a" fed from the black insertion driving control section 1, a voltage (display data voltage) corresponding to display data based on the input video signal VD to each of the data electrodes of the liquid crystal display panel 4 and then the black insertion driving operation is performed in which a black frame having a gray level of, for example, "0" is uniformly inserted during each frame period. The gate driver 3, in response to the control signal "b" fed from the black insertion driving control section 1, applies line-sequentially a scanning signal OUT to each of the scanning electrodes of the liquid crystal display panel 4.

In the conventional liquid crystal display device, as shown in FIG. 19, each of scanning electrodes (corresponding to lines 1, 2, . . . , 2N−1, 2N) of the liquid crystal display panel 4 is line-sequentially driven and, after display data [1] corresponding to the input video signal VD is written into a corresponding pixel region, black data is written and one frame ends. Thereafter, the similar operations by the application of display data [2], [3], [4], and black data are repeated for every frame. As a result, as shown in FIG. 20, a driving frequency for a liquid crystal display panel 4 becomes twice as high as a frame frequency and a frequency of a signal for each of the display data D, control signal "a", control signal "b" and scanning signal OUT doubles when compared with the case of no black insertion driving and time required for writing into the liquid crystal display panel and time for holding the written pixel data are reduced to half when compared with the case of no black insertion driving. Furthermore, a frequency of the inversion of the polarity of display data voltage D doubles and, therefore, a frequency of the control signal "a" shown in FIG. 18 doubles as well.

In addition to the liquid crystal display device described above, other liquid crystal display devices of this type are disclosed, for example, in following reference. In the driving method of a conventional liquid crystal display device for a TV (Television Set) disclosed in Japanese Patent Application Laid-open No. Hei 04-044478, as shown in FIG. 21, an interlaced driving operation is performed in each odd field during which each of odd-numbered rows of scanning electrodes out of scanning electrodes (corresponding to lines 1, 2, . . . , 2N−1, 2N) of the liquid crystal display panel is successively driven and in each even field during which each of even-numbered rows of scanning electrodes is successively driven. The odd field and even field appear repeatedly with time width of a refresh rate. In the former half of the odd-field, display data ([1], [3], . . . ,) corresponding to an input video signal is written in each pixel region corresponding to the odd-numbered rows of scanning electrodes, while, in the latter half of the odd-field, black data is simultaneously written in each of pixel regions corresponding to all odd-numbered rows of scanning electrodes. Moreover, in the former half of the even field, display data ([2], [4], . . . ,) corresponding to an input video signal is written in each of pixel regions corresponding to the even-numbered rows of scanning electrodes and, in the latter half of the even field, black data is simultaneously written in each of the pixel regions corresponding to all even-numbered rows of scanning electrodes.

However, the conventional liquid crystal display device described above has following problems. That is, the liquid crystal display device shown in FIG. 18 presents a problem in that, an operational frequency for each component doubles when compared with the case of no black insertion driving and, therefore, hardware configurations corresponding to the doubled driving frequency are required, as a result, causing an increase in scale and in power consumption. Also, the conventional liquid crystal display device presents another problem in that each of the scanning electrodes is line-sequentially driven and, as shown in FIG. 20, the polarity of a voltage of display data D is inverted on every line and this inverted pattern is reversed again per every refresh rate and, therefore, the polarity of the voltage of display data is biased in some regions on the liquid crystal display panel, causing the occurrence of a screen burn-in. In addition, though the problem of trail-leaving is improved by black insertion driving, alternate flashing occurs between the time for black display and time for video display in a frequency band in which a human can recognize, which causes an increase of flickering on a screen. In order to suppress the flickering, a refresh rate needs to be raised to a degree to which a human cannot recognize, which, as a result, the operational frequency doubled by the black insertion driving is further increased twice, thus causing a difficulty in hardware configurations.

Moreover, the driving method disclosed in Japanese Patent Application Laid-open No. Hei 04-044478 presents a problem in that, though an operational frequency of a signal for each component is allowed to be made lower by performing the interlaced driving operation, since, in the latter half of an odd field, black data is simultaneously written in each of pixel regions corresponding to all the odd-numbered rows of scanning electrodes and, in the latter half of the even field, black data is simultaneously written in each of the pixel regions corresponding to all the even-numbered rows of scanning electrodes, time for holding the written black data varies on every line, which causes a variation in luminance between an upper part and lower part of a display screen.

SUMMARY OF THE INVENTION

In view of the above, it is an object of the present invention to provide a liquid crystal display device having a comparatively simple configuration which is capable of reducing moving-image blurring, burn-in, flickering, and variation in luminance on a display screen and a driving control circuit and driving method to be employed in the liquid crystal display device.

According to a first aspect of the present invention, there is provided a liquid crystal display device for obtaining displayed images by driving a plurality of rows of scanning electrodes and a plurality of columns of data electrodes, both being arranged so as to be orthogonal to one another, according to an input video signal so that specified display data is written in each pixel region corresponding to a liquid crystal layer, including:

a driving control unit to perform a field dividing driving operation by which an odd field during which each of scanning electrodes in odd-numbered rows is sequentially driven and an even field during which each of scanning electrodes in even-numbered rows is sequentially driven occur alternately and repeatedly during every frame period and in which an odd/even field is divided into a first odd/even sub-field and a second odd/even sub-field and, during the first odd/even sub-field, display data corresponding to the input video signal is line-sequentially written in each pixel region and, during the second odd/even sub-field, dark data is line-sequentially written in each pixel region.

In the foregoing, a preferable mode is one wherein a polarity of a voltage of data to be written in each of pixel regions corresponding to the scanning electrodes in odd-numbered rows is inverted in every odd field and a polarity of a voltage of data to be written in each of pixel regions corresponding to the scanning electrodes in even-numbered rows is inverted in every even field.

Also, a preferable mode is one wherein the dark data is black data.

Also, a preferable mode is one wherein, during the odd field, each of the scanning electrodes in odd-numbered rows is successively driven and, simultaneously, each of the scanning electrodes in even-numbered rows existing next to each of scanning electrodes in the odd-numbered rows is driven and wherein, during the even field, each of the scanning electrodes in even-numbered rows is successively driven and, simultaneously, each of the scanning electrodes in odd-numbered rows existing before each of the scanning electrodes in the even-numbered rows is successively driven.

According to a second aspect of the present invention, there is provided a driving control circuit to be used in a liquid crystal display device for obtaining displayed images by driving a plurality of rows of scanning electrodes and a plurality of columns of data electrodes, both being arranged so as to be orthogonal to one another, according to an input video signal so that specified display data is written in each pixel region corresponding to a liquid crystal layer, including:

a controller to perform a field dividing driving operation by which an odd field during which each of scanning electrodes in odd-numbered rows is sequentially driven and an even field during which each of scanning electrodes in even-numbered rows is sequentially driven occur alternately and repeatedly in every frame period and in which an odd/even field is divided into a first odd/even sub-field and a second odd/even sub-field and, during the first odd/even sub-field, display data corresponding to the input video signal is line-sequentially written in each pixel region and, during the second odd/even sub-field, dark data is line-sequentially written in each pixel region.

In the foregoing, a preferable mode is one wherein the polarity of a voltage of data to be written in each of pixel regions corresponding to the scanning electrodes in odd-numbered rows is inverted in every odd field and the polarity of a voltage of data to be written in each of pixel regions corresponding to the scanning electrodes in even-numbered rows is inverted in every even field.

Also, a preferable mode is one wherein the dark data is black data.

Also, a preferable mode is one wherein, during the odd field, each of the scanning electrodes in odd-numbered rows is successively driven and, simultaneously, each of the scanning electrodes in even-numbered rows existing next to each of scanning electrodes in the odd-numbered rows is driven and wherein, during the even field, each of the scanning electrodes in even-numbered rows is successively driven and, simultaneously, each of the scanning electrodes in odd-numbered rows existing before each of scanning electrodes in the even-numbered rows is successively driven.

According to a third aspect of the present invention, there is provided a driving method to be used in a liquid crystal display device for obtaining displayed images by driving a plurality of rows of scanning electrodes and a plurality of columns of data electrodes, both being arranged so as to be orthogonal to one another, according to an input video signal so that specified display data is written in each pixel region corresponding to a liquid crystal layer, including:

a step of performing a field dividing driving operation by which an odd field during which each of scanning electrodes in odd-numbered rows is sequentially driven and an even field during which each of scanning electrodes in even-numbered rows is sequentially driven occur alternately and repeatedly in every frame period and in which an odd/even field is divided into a first odd/even sub-field and a second odd/even sub-field and, during the first odd/even sub-field, display data corresponding to the input video signal is line-sequentially written in each pixel region and, during the second odd/even sub-field, dark data is line-sequentially written in each pixel region.

In the foregoing, a preferable mode is one wherein the polarity of a voltage of data to be written in each of pixel regions corresponding to the scanning electrodes in odd-numbered rows is inverted in every odd field and the polarity of a voltage of data to be written in each of pixel regions corresponding to the scanning electrodes in even-numbered rows is inverted in every even field.

Also, a preferable mode is one wherein the dark data is black data.

Also, a preferable mode is one wherein, during the odd field, each of the scanning electrodes in odd-numbered rows is successively driven and, simultaneously, each of the scanning electrodes in even-numbered rows existing next to each of scanning electrodes in the odd-numbered rows is driven and wherein, during the even field, each of the scanning electrodes in even-numbered rows is successively driven and, simultaneously, each of the scanning electrodes in odd-numbered rows existing before each of scanning electrodes in the even-numbered rows is successively driven.

With the above configuration, the field dividing driving operation is performed in which an odd field and an even field occur repeatedly and the odd/even field is divided into the first odd/even sub-field and second odd/even sub-field and, during the period of the first odd/even sub-field, display data corresponding to an input video signal is line-sequentially written in each of pixel regions and, during the period of the second odd/even sub-field, dark data is line-sequentially written to each of the pixel regions and, therefore, an operational frequency of a signal for each component can be reduced to half. As a result, if a frequency for switching between the odd field and even field is the same as a frame frequency, the conventional doubled increase in frequency caused by black insertion driving can be offset by a by-half decrease in frequency achieved by the driving method of the present invention, which enables the provision of the liquid crystal display device capable of reducing blurring of moving images without causing doubling in operational frequency of a signal for each component, and a driving control circuit and driving method employed in the liquid crystal display device. Further, by setting the frequency for switching between the odd and even fields at a frequency being twice higher than the frame frequency, a doubled increase in frequency caused by the increased frame frequency can be offset by the by-half decrease in frequency achieved by the driving method of the present invention and, therefore, at the operational frequency of the signal for each component being the same as the conventional frequency for black insertion driving, a flashing frequency for black display and video display can be doubled, which enables the provision of the liquid crystal display device capable of reducing blurring of moving images and flickering caused by black insertion, and the driving control circuit and driving method employed in the liquid crystal display device. In addition, since time required for holding display data and black data in each of pixel regions corresponding to each scanning electrode is made equal, the occurrence of a variation in luminance in an upper portion and lower portion of the display screen can be prevented.

With another configuration as above, the polarity of a voltage of data to be written in each of the pixel regions corresponding to the scanning electrodes in odd-numbered rows is inverted in every odd field and the polarity of a voltage of data to be written in each of the pixel regions corresponding to the scanning electrodes in even-numbered rows is inverted in every even field and, therefore, biasing of the polarity of a voltage of display data depending on regions of the liquid crystal display panel is reduced and screen burn-in can be decreased. As a result, if the frequency for switching between the odd field and even field is the same as the frame frequency, time for holding black data as dark data is made longer and, therefore, even in the liquid crystal display panel in which the effect of black insertion cannot be exploited fully due to a slow response time from all white to all black such as an IPS (In-Plane Switching)-type liquid crystal, black insertion driving can be easily achieved. Furthermore, in the odd field, each of the scanning electrodes in the odd-numbered rows is successively driven and, at the same time, each of the scanning electrodes in the even-numbered rows existing next to the scanning electrodes in the odd-numbered rows is successively driven, which improves luminance efficiency of the liquid crystal display device.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings. By combining the field dividing driving operation and the black insertion driving operation, a doubled increase in frequency of a signal for each component caused by the black inserting driving operation is offset by a by-half decrease in frequency in a signal for each component achieved by the field dividing driving operation, which enables the provision of a liquid crystal display device capable of reducing blurring of moving images without doubling the frequency of a signal for each component, a driving control circuit and driving method to be used for the liquid crystal display. By combining the field dividing driving operation with the black insertion driving operation, an increase in frequency of a signal for each component caused by an increase in frame frequency is offset by a by-half decrease in frequency of a signal for each component achieved by the field dividing driving operation, which also enables the provision of the liquid crystal display device capable of reducing blurring of moving images and removing flickering caused by the black insertion driving operation, the driving control circuit and driving method to be used for the liquid crystal display device.

First Embodiment

Figure 1:
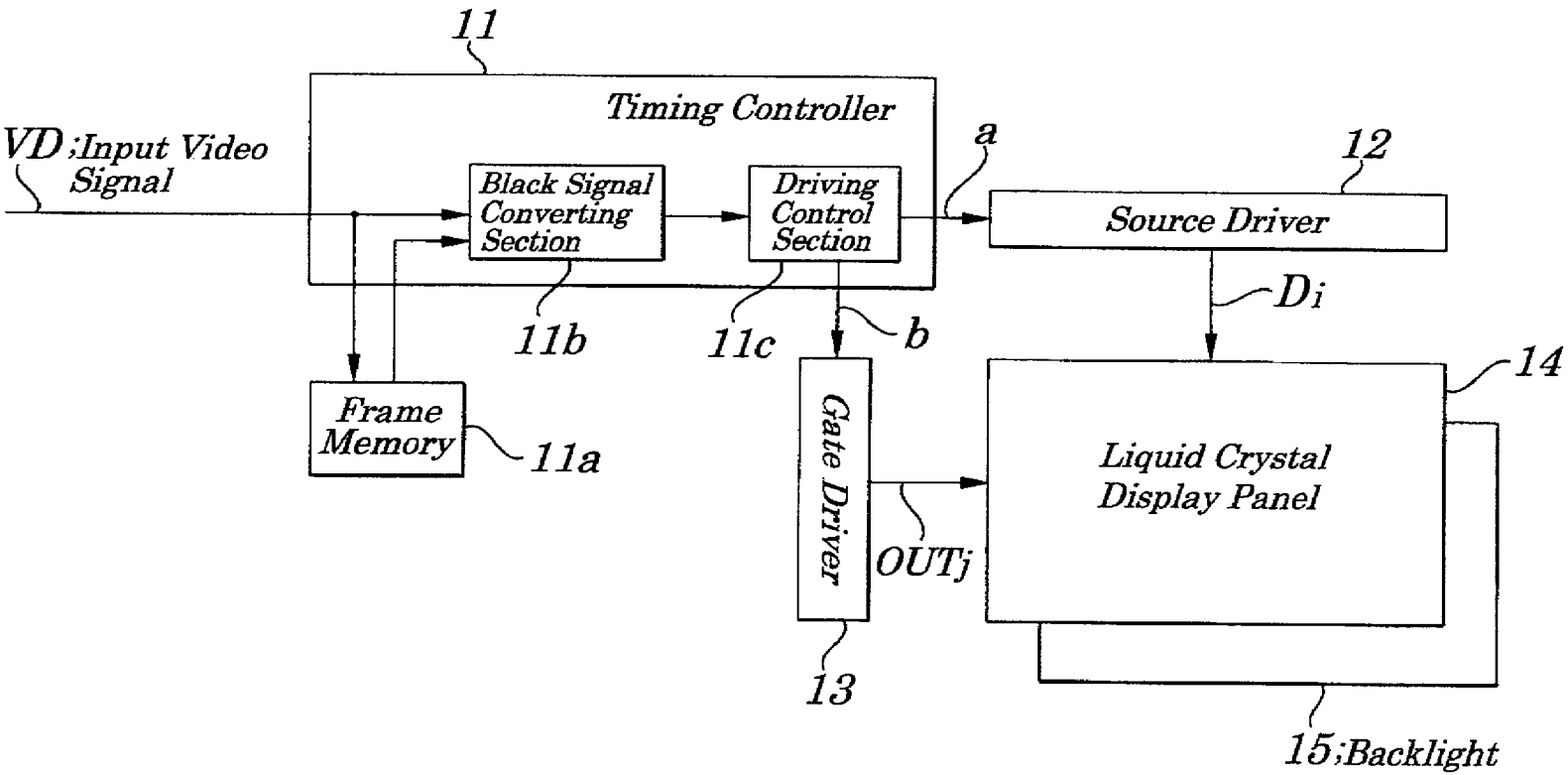
FIG. 1 is a block diagram showing electrical configurations of main components of a liquid crystal display device according to a first embodiment of the present invention.

FIG. 1 is a block diagram showing electrical configurations of main components of a liquid crystal display device of the first embodiment of the present invention. The liquid crystal display device of the first embodiment, as shown in FIG. 1, includes a timing controller 11, a source driver 12, a gate driver 13, a liquid crystal display panel 14, and a backlight 15.

Figure 2:
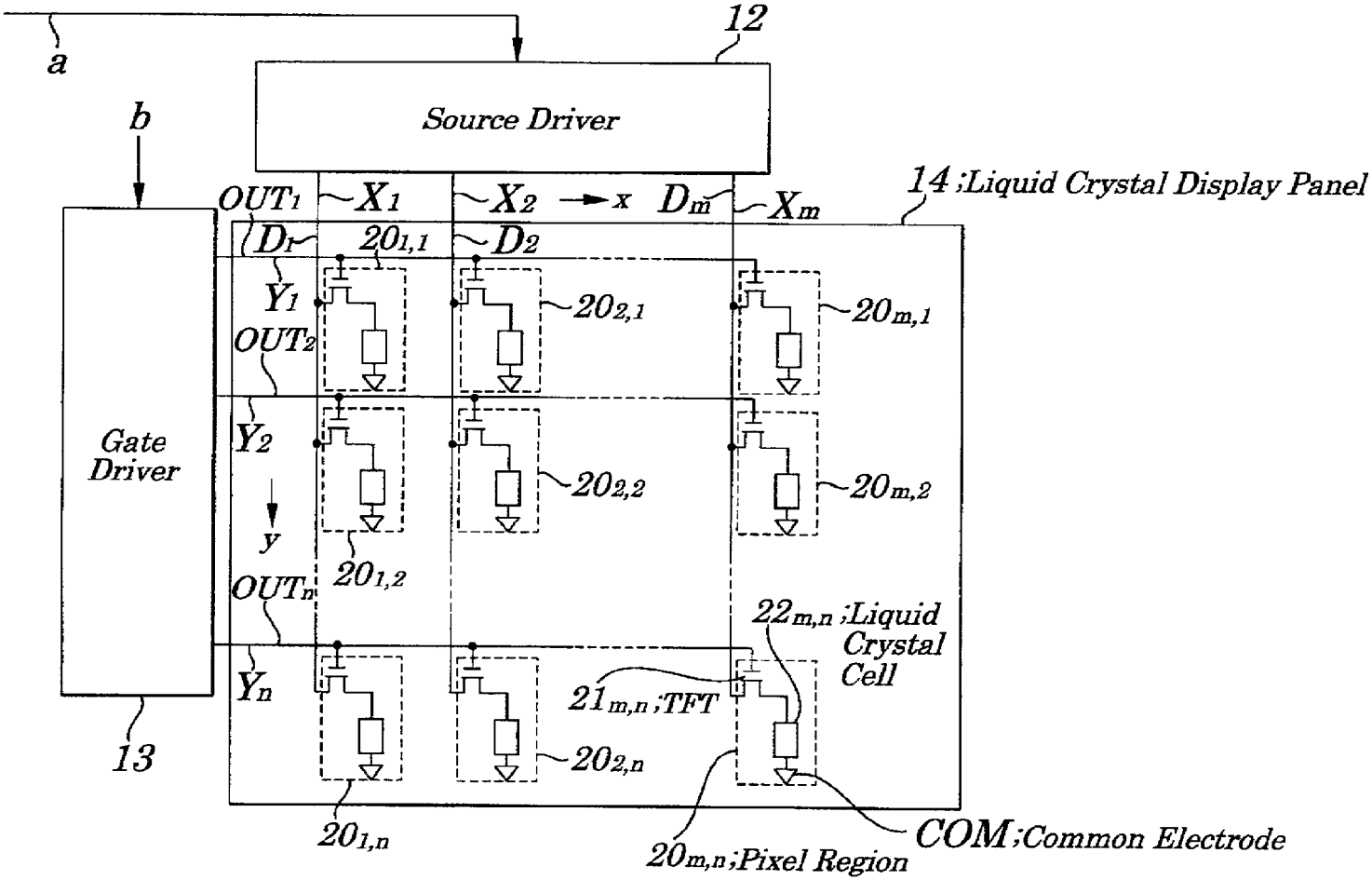
FIG. 2 is a schematic diagram showing one example of electrical configurations of a liquid crystal display panel of FIG. 1.

FIG. 2 is a schematic diagram showing one example of electrical configurations of the liquid crystal display panel of FIG. 1. The liquid crystal display panel 14 is of a transmissive-type that permits light from the backlight to come in and in which, as shown in FIG. 2, a plurality of columns of data electrodes Xi (i=1, 2, . . . , m, for example, m=640×3), a plurality of rows of scanning electrodes Yj (j=1, 2, . . . , n; for example, n=480) so arranged as to be orthogonal to the data electrodes Xi, and pixel regions 20*i,j*. Each of the data electrodes Xi is formed at specified intervals in an x direction and receive corresponding display data Di. Each of the scanning electrodes Yj is formed at specified intervals in a y-direction orthogonal to the x direction and receive scanning signals OUTj used to write the display data Di. Each of the pixel regions 20*i,j* is formed in an intersection region of each of the data electrodes Xi and each of the scanning electrodes Yj in a one-to-one relationship and includes each of TFTs (Thin Film Transistor) 21*i,j*, each liquid crystal cell 22*i,j*, each of common electrodes COM. Each of the TFTs 21*i,j* is on-off controlled based on the scanning signal OUTj and supplies the display data Di to each liquid crystal cell 22*i,j* when getting into an ON state.

In the liquid crystal display panel 14, each of the scanning electrodes Yj and data electrodes Xi is driven in such a way that each of the scanning signals OUTj is applied to each of the scanning electrodes Yj in the order corresponding to interlaced driving and simultaneously the display data Di is written to each of the data electrodes Xi and, as a result, display data Di having a specified voltage is written to each of the pixel regions 20*i,j* corresponding to the display data Di and an orientation state of the liquid crystal cell 22*i,j* making up the liquid crystal layer of the liquid crystal display panel 14 is controlled based on the specified voltage, which causes optical transmittance to be changed and a display image is obtained. The source driver 12 applies, based on a control signal "a" fed from the timing controller 11, display data Di, by one operation, to each of the data electrodes Xi of the liquid crystal display panel 14. The gate driver 13 applies, based on a control signal "b" fed from the timing controller 11, the scanning signal OUTj to each of the scanning electrodes Yj of the liquid crystal display panel 14, in order corresponding to field dividing driving.

Figure 3:
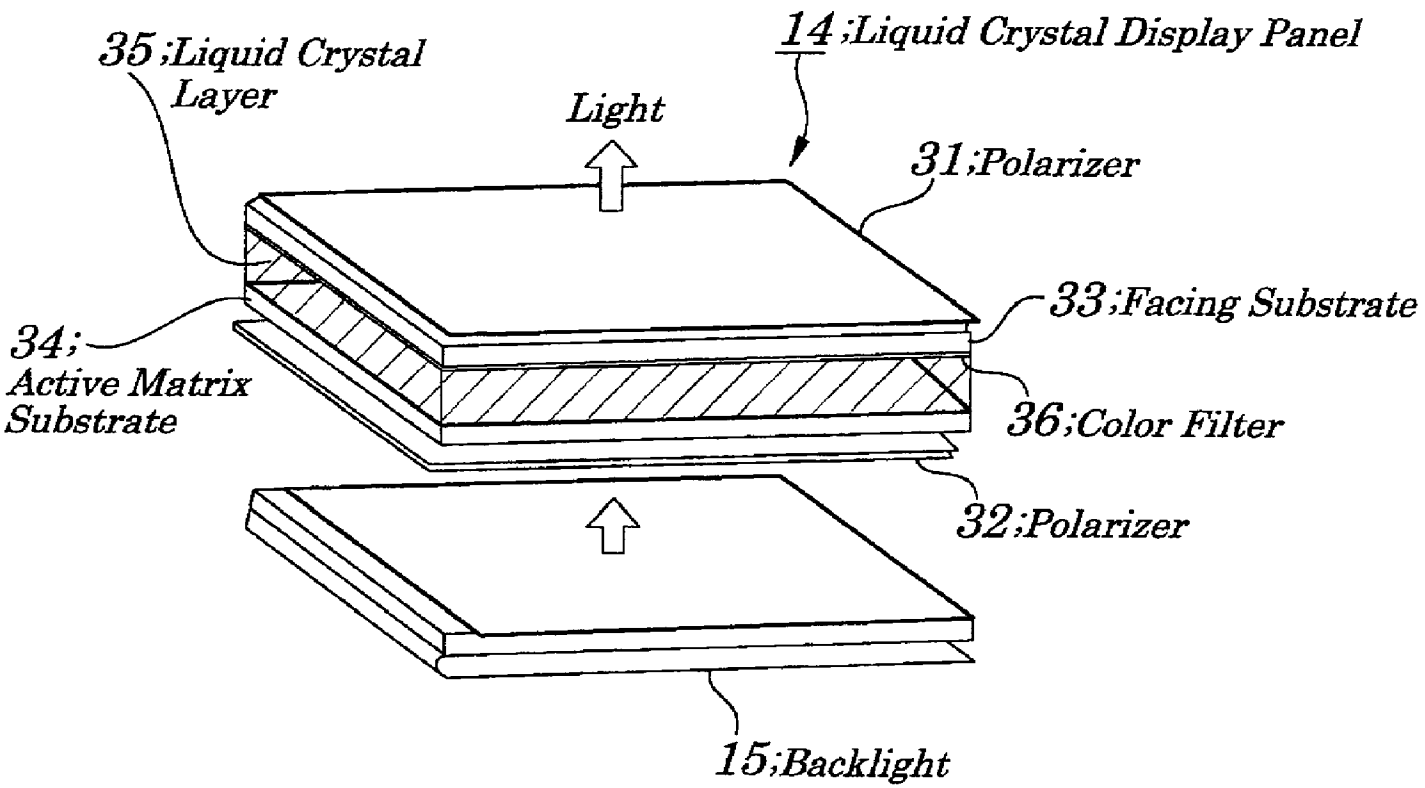
FIG. 3 is a diagram schematically showing configurations of the liquid crystal display panel and a position of a backlight of FIG. 1.

FIG. 3 is a diagram showing schematic configurations of the liquid crystal display panel 14 and a position of the backlight 15 of FIG. 1. The liquid crystal display panel 14, as shown in FIG. 3, includes a pair of polarizers 31 and 32, a facing substrate 33, an active matrix substrate 34, and a liquid crystal layer 35 being sandwiched between the facing substrate 33 and the active matrix substrate 34. On the facing substrate 33 are formed the common electrodes COM shown in FIG. 2 and color filters 36 of red (R), green (G), and blue (B). One dot is made up of three pixels of R, G, and B. On the active matrix substrate 34 are formed the TFTs 21*i, j* or a like. The backlight 15 is mounted on a rear side of the liquid crystal display panel and light from, for example, an LED (Light Emitting Diode) is used as a flat light source and is configured to have approximately the same size, as a whole, as that of a display screen of the liquid crystal display panel 14.

In the liquid crystal display panel 14, white light from the backlight 15, after having passed through the polarizer 32, is changed to be linearly polarized light to come in the liquid crystal layer 35. The liquid crystal layer 35 is made up of, for example, an IPS (In-Plane Switching)-type liquid crystal which has a function of changing a direction of a polarization axis, however, this function is determined according to an orientation state of the liquid crystal and, therefore, the direction of the polarization axis is controlled by a voltage corresponding to display data Di. Whether or not emitted light is absorbed by the polarizer 32 is determined depending on a direction of the polarization axis of light emitted from the liquid crystal layer 35. Thus, optical transmittance is controlled by a voltage corresponding to display data Di. Light passing through each pixel is processed through additive mixture of color stimuli by R, G, and B of the color filter 36 to display a color image.

The timing controller 11 shown in FIG. 1 includes a frame memory 11*a*, a black signal converting section 11*b*, and a driving control section 11*c*. The frame memory 11*a* stores an input video signal VD. By using data fed from the frame memory 11*a*, the black signal converting section 11*b* creates successively odd-numbered video sub-fields made up of video signals from the scanning electrodes Yj (j=2k−1, k=1, 2, . . . , N, 2N=n) in odd-numbered rows, odd dark sub-fields made up of dark signals from the scanning electrodes Yj in the odd-numbered rows, and even video sub-fields made up of video signals of the scanning electrodes Yj (j=2k, k=1, 2, . . . , N, 2N=n) in even-numbered rows, even dark sub-fields made up of dark signals of the scanning electrodes Yj in the even-numbered rows. The driving control section 11*c* sends out a sub-field video signal created by the black signal converting section 11*b*, the control signal "a" to the source driver 12, and the control signal "b" to the gate driver 13, with specified timing based on a frame frequency of the input video signal VD. The driving control section 11*c* writes line-sequentially display data blocks corresponding the input video signals VD in the pixel regions 20*i,j* corresponding to the scanning electrode Yj in odd-numbered rows in the former half of the odd field (during a period of the first odd sub-field) and line-sequentially black data blocks in the pixel regions 20*i,j* corresponding to the scanning electrodes Yj in the odd-numbered rows in the latter half of the odd field (during a period of the second odd sub-field), and line-sequentially display data blocks corresponding to the input video signals VD in the pixel region 20*i,j* corresponding to the scanning electrodes Yj in even-numbered rows in the former half of the even field (during a period of the first even sub-field) and line-sequentially black data blocks in the pixel regions 20*i,j* corresponding to the scanning electrodes Yj in the even-numbered rows in the latter field of the even field (during a period of the second even sub-field).

Also, the driving control section 11*c* inverts a polarity of a voltage of each of data blocks to be written in the pixel regions 20*i,j* corresponding to the scanning electrodes Yj in odd-numbered rows in every odd field and inverts a polarity of a voltage of each of data blocks to be written in the pixel regions 20*i,j* corresponding to the scanning electrodes Yj in even-numbered rows in every even field. The backlight 15 is driven by a backlight driving circuit (not shown) based on a control signal (not shown) fed from the timing controller 11. The above timing controller 11, the source driver 12, and the gate driver 13 make up a driving control circuit. Moreover, when a resolution standard of the liquid crystal display panel 14 is, for example, an XGA (eXtended Graphics Array), a field frequency of an input video signal is 60.00 Hz, when the standard is a VGA (Video Graphics Array), the field frequency of the input video signal is 59.94 Hz, and when the standard is an SVGA (Super Video Graphics Array), the frequency is 60.32 Hz.

Figure 4:
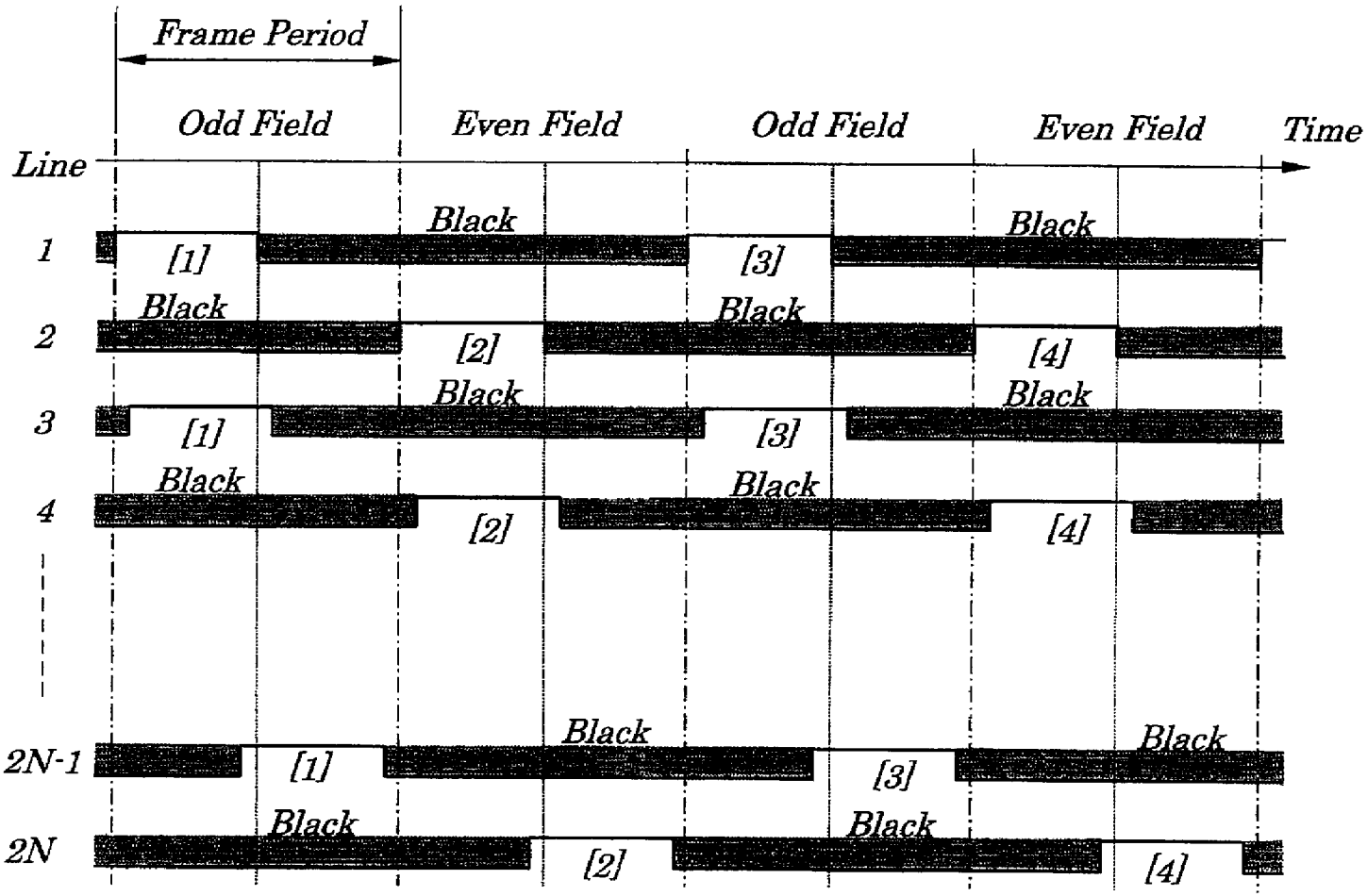
FIG. 4 is a time chart explaining operations of the liquid crystal display device of FIG. 1.
Figure 5:
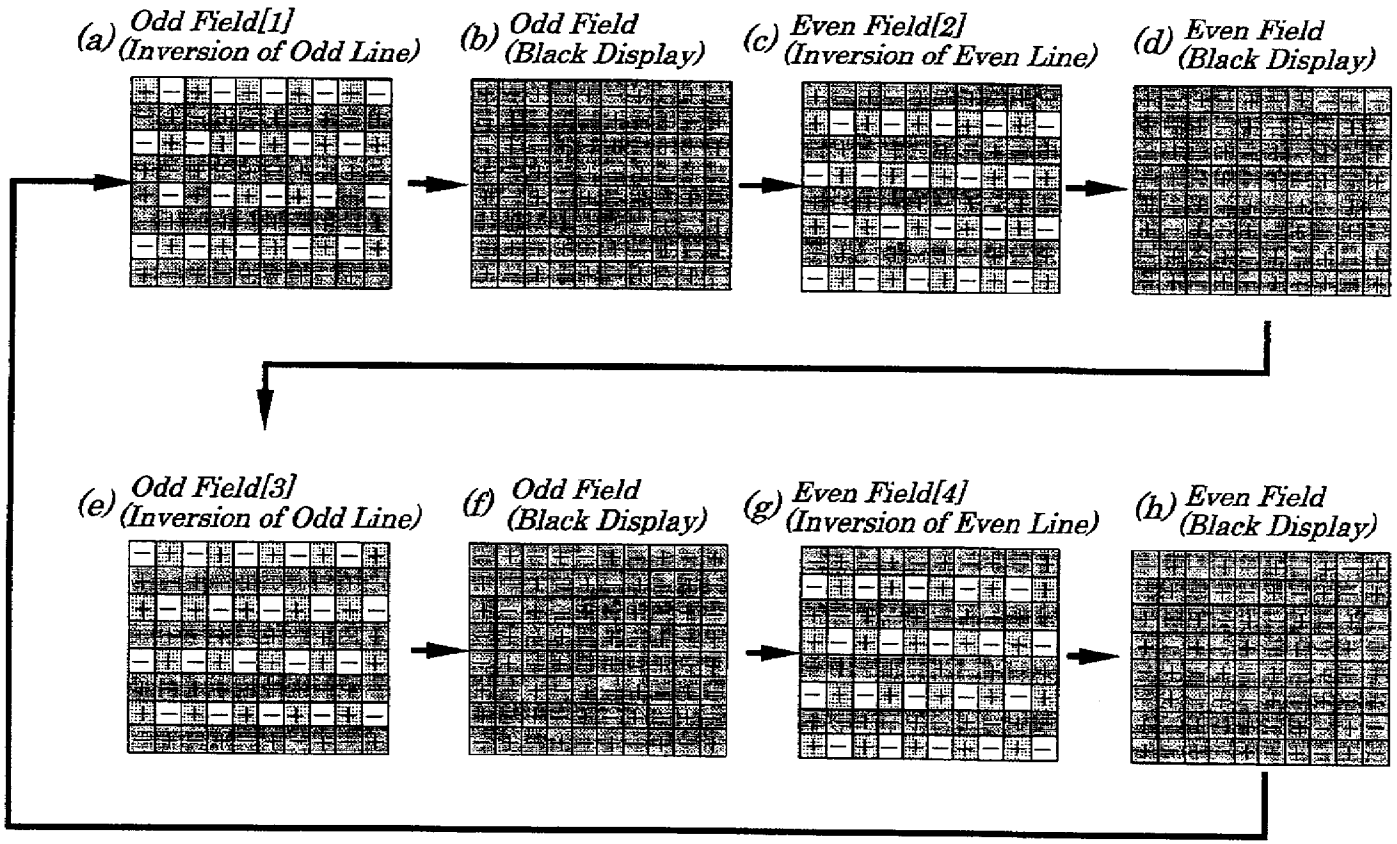
FIG. 5 is a diagram explaining an inversion of a voltage of data to be written in each of pixel regions of FIG. 2.
Figure 6:
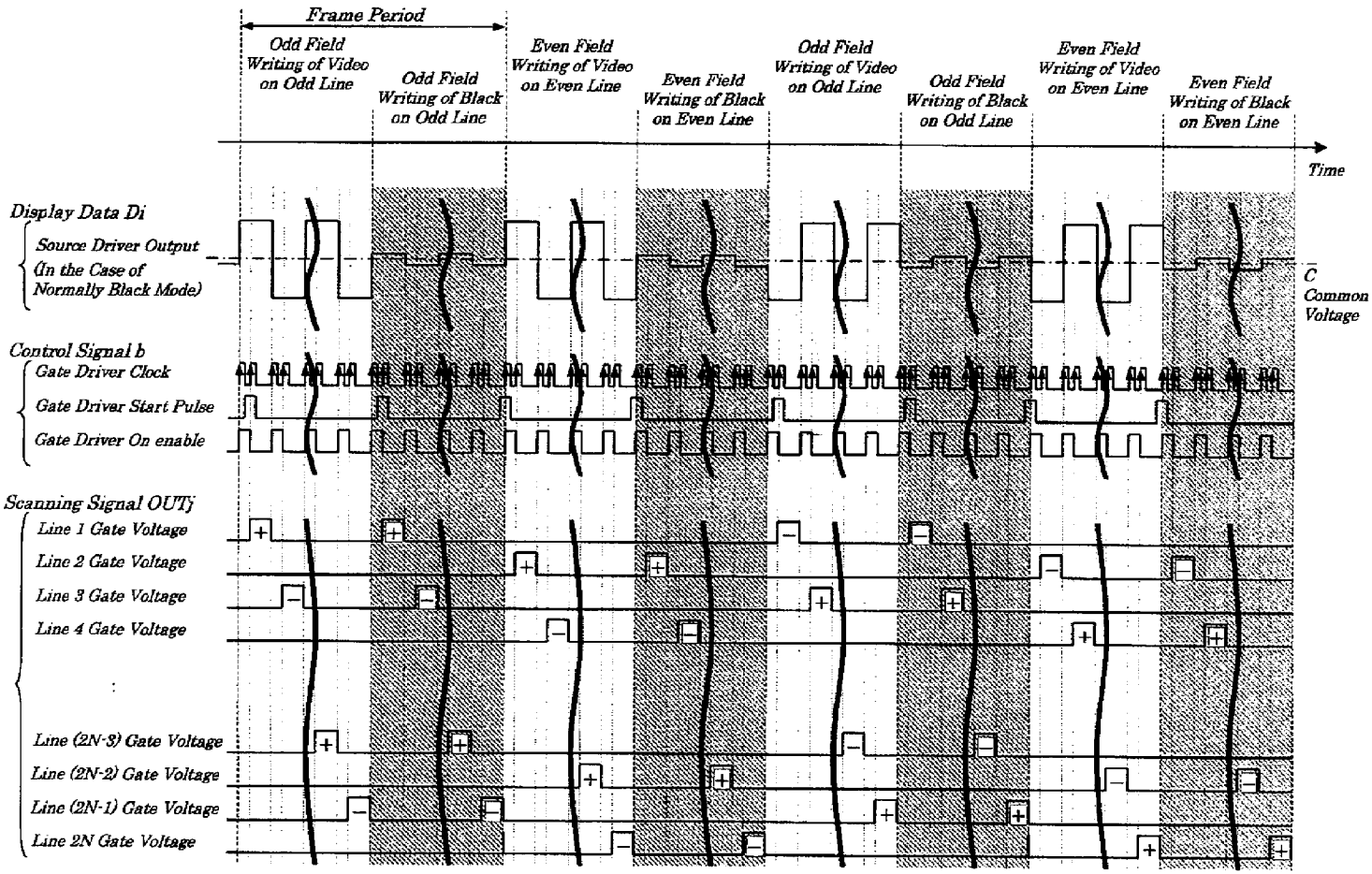
FIG. 6 is a diagram of a waveform of a signal of each component explaining operations of the liquid crystal display device of FIG. 1.

FIG. 4 is a time chart explaining operations of the liquid crystal display device of FIG. 1. FIG. 5 is a diagram explaining the inversion of a voltage of data to be written in pixel regions 20*i,j* of FIG. 2. FIG. 6 is a diagram of a waveform of a signal of each component explaining operations of the liquid crystal display device of FIG. 1. Processing of a driving method for the liquid crystal display device of the first embodiment of the present invention is described by referring to these drawings. In the liquid crystal display device, a field dividing driving method is performed in which an odd field during which each of the scanning electrodes Yj in odd-numbered rows is successively driven by the driving control section 11*c* in the odd field and an even field during which each of the scanning electrodes Yj in even-numbered rows is successively driven by the driving control section 11*c* occur alternately and repeatedly an one frame corresponding to the input video signal VD is provided. In this situation, after, in the former half (during a period of the first odd sub-field) of each of the odd fields, display data corresponding to the input video signals VD is written line-sequentially in each of the pixel regions 20*i,j* corresponding to the scanning electrodes Yj in odd-numbered rows, in the latter half (during a period of the second odd sub-field) of each of the odd fields, black data is line-sequentially written in each of the pixel regions 20*i,j* corresponding to the scanning electrodes Yj in the odd-numbered rows. Next, after, in the former half (during a period of the first even sub-field) of each of the even fields, display data corresponding to the input video signal VD is written line-sequentially in each of the pixel regions 20*i,j* corresponding to the scanning electrodes Yj in even-numbered rows, in the latter half (during a period of the second even sub-field) of each of the even fields, black data is line-sequentially written in each of the pixel regions 20*i,j* corresponding to the scanning electrodes Yj in the even-numbered rows.

Moreover, in this embodiment, the input video signal VD is created based on a standard corresponding to interlaced driving and has time corresponding to each of the odd-field and even-field. The polarity of a voltage of data to be written in each of the pixel regions 20*i,j* corresponding to the scanning electrodes Yj in odd-numbered rows is inverted in every odd field and the polarity of a voltage of data to be written in each of the pixel regions 20*i,j* corresponding to the scanning electrode Yj in even-numbered rows is inverted in every even field.

That is, as shown in FIG. 4, in the embodiment, the field dividing driving operation is performed in which each of scanning electrodes in odd-numbered rows out of scanning electrodes (line 1, 2, . . . , 2N−1, 2N) of the liquid crystal display panel 14 is successively driven in the odd field and each of the scanning electrodes in even-numbered rows is successively driven in the even field. The odd field and even field occur alternately and repeatedly at its respective frame frequency. In the former half of the odd field (during a period of the first odd sub-field), display data ([1], [3], . . . ) corresponding to the input video signals VD is line-sequentially written in each of the pixel regions corresponding to the scanning electrodes in odd-numbered rows and, in the latter half of the odd field (during a period of the second odd sub-field), black data is line-sequentially written in each of the pixel regions corresponding to the scanning electrodes in the odd-numbered rows. In the former half of the even field (during a period of the first even sub-field), display data ([2], [4], . . . ) corresponding to the input video signals VD is line-sequentially written in each of the pixel regions corresponding to the scanning electrodes in even-numbered rows and, in the latter half of the even field (during a period of the second even sub-field), black data is line-sequentially written in each of the pixel regions corresponding to the scanning electrodes in the even-numbered rows.

Moreover, the polarity of a voltage of display data to be written in each of the pixel regions 20*i,j*, for example, as shown in FIG. 5(*a*), display data [1] corresponding to scanning electrodes (odd-line) in odd-numbered rows is inverted in contrast to the polarity shown in FIG. 5(*h*) in the former half of the odd field and then, as shown in FIG. 5(*b*), in the latter half of the odd field, black data is written in each of the pixel regions 20*i,j* with the same polarity occurred in the former half of the odd field being unchanged. Also, as shown in FIG. 5 (*c*), in the former half of the even field, the polarity of a voltage of display data [2] to be written in each of the pixel regions 20*i,j* corresponding to scanning electrodes (even-line) in even-numbered rows is inverted from the polarity shown in FIG. 5(*b*) and, as shown in FIG. 5(*d*), in the latter half of the even field, black data is written into each of the pixel regions 20*i,j* with the same polarity occurred in the former half of the even field being unchanged.

Also, as shown in FIG. 5(*e*), in the former half of the odd field, the polarity of a voltage of display data [3] to be written into each of the pixel regions 20*i,j* corresponding to scanning electrodes (odd-line) in odd-numbered rows is reversed from the polarity shown in FIG. 5(*d*) and then, as shown in FIG.

5(*f*), in the latter half of the odd field, black data is written into each of the pixel regions 20*i,j* with the same polarity occurred in the former half of the odd field being unchanged. Furthermore, as shown in FIG. 5 (*g*), in the former half of the even field, the polarity of a voltage of display data [4] to be written in each of the pixel regions 20*i,j* corresponding to scanning electrodes (even-line) in even-numbered rows is inverted from the polarity shown in FIG. 5(*f*) and, as shown in FIG. 5(*h*), in the latter half of the even field, black data is written into each of the pixel regions 20*i,j* with the same polarity occurred in the former half of the even field being unchanged.

Thus, as shown in FIG. 6, a doubled increase in frequency of the display data caused by black insertion is offset by a by-half decrease in frequency achieved by the driving method of the present invention. That is, if a frequency in switching between the odd field and even field is the same as a frame frequency of the input video signals VD, each of a frequency of a signal for the display data Di, control signal "a", and scanning signal OUTj becomes equal to each of frequencies occurring when no black insertion is performed and time required for display data in the liquid crystal display panel becomes equal to that required when no black insertion is performed. Also, a frequency of inversion of the polarity of a voltage of the display data Di becomes equal to that occurring when no black insertion is performed. Two gate driver clocks making up the control signal "b" are applied per one line to the gate driver 13 and a gate voltage only corresponding an odd line in the odd field is output by a gate driver on-enable pulse also making up the control signal "b" and, therefore, a scanning signal OUTj corresponding to the field dividing driving operation is output.

As described above, according to the first embodiment, the driving control section 11*c* performs the field dividing driving operation by which an odd field and even field occur repeatedly and alternately. In the former half of the odd field, display data is line-sequentially written in each of the pixel regions 20*ij* corresponding to the scanning electrodes Yj in odd-numbered rows and, in the latter half of the odd field, black data is line-sequentially written in each of the pixel regions 20*ij* corresponding to the scanning electrodes Yj in odd-numbered rows and, further, in the former half of the even field, display data is line-sequentially written in each of the pixel regions 20*ij* corresponding to the scanning electrodes Yj in even-numbered rows and, in the latter half of the even field, black data is line-sequentially written in each of the pixel regions 20*ij* corresponding to the scanning electrodes Yj in even-numbered rows. As a result, if a frequency of switching between the odd field and even field is the same as a frame frequency, doubling in frequency caused by the conventional black insertion can be offset by the by-half decrease in the frequency achieved by the present invention and, therefore, doubling in frequency of a signal of each component caused by the black insertion can be avoided, which enables the provision of the liquid crystal display device capable of reducing blurring of moving images and the driving control circuit and driving method to be used in the liquid crystal display device. In addition, since time required for holding display data and black data for each line is made equal, a variation in luminance in an upper portion and lower portion of the display screen does not occur.

Figure 7:
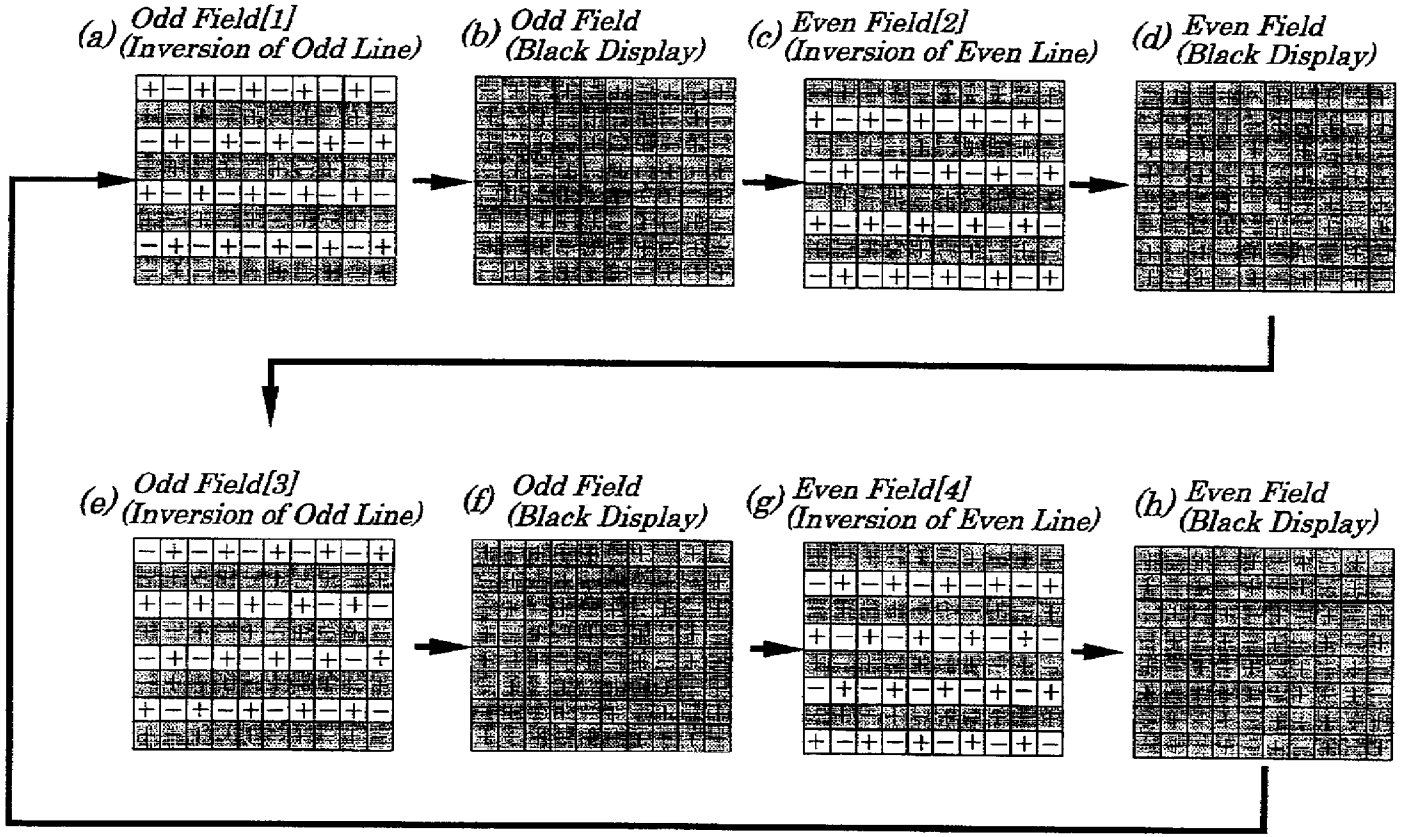
FIG. 7 is a diagram explaining another example of the inversion of a voltage of data to be written in each of the pixel regions of FIG. 2.
Figure 8:
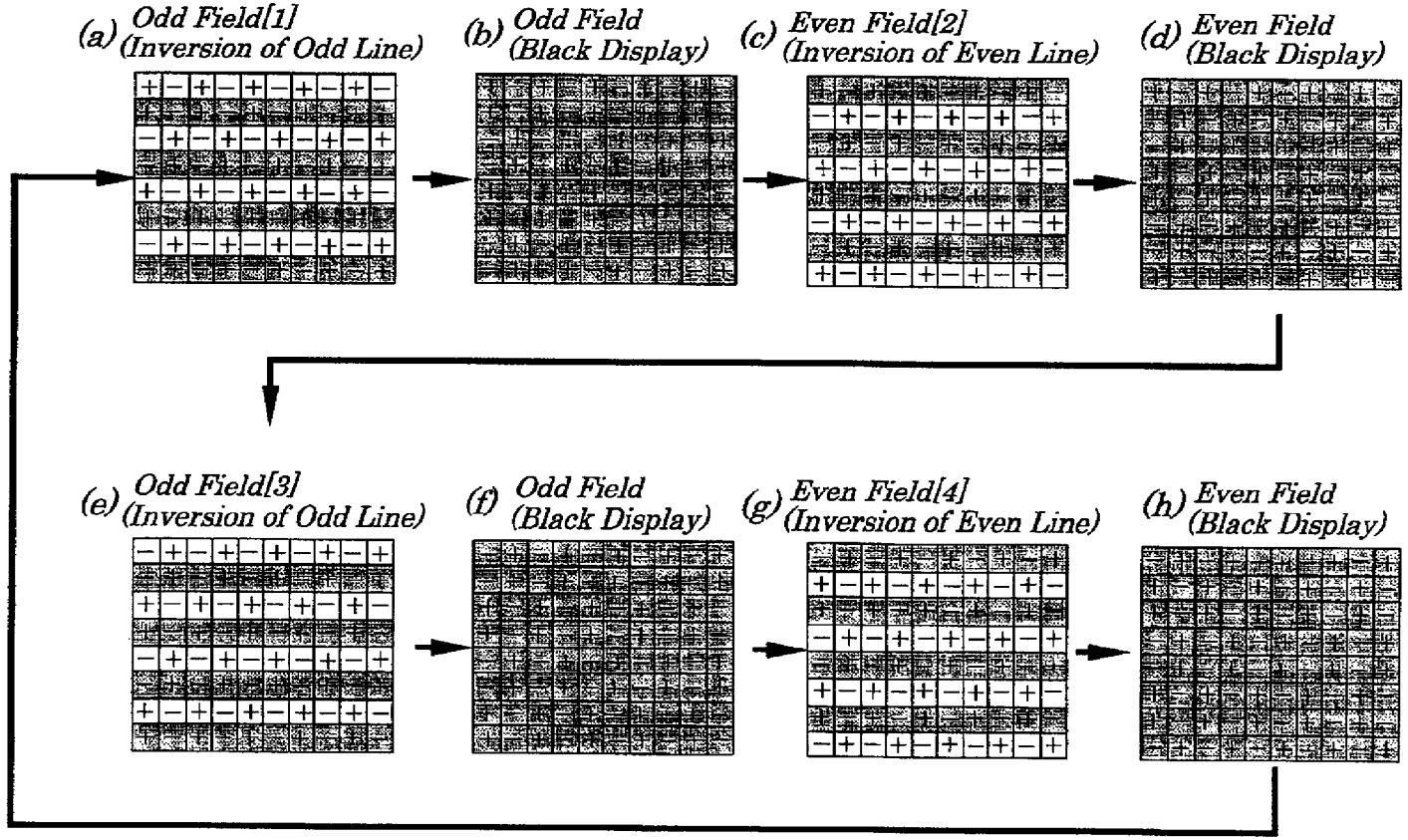
FIG. 8 is a diagram explaining still another example of the inversion of a voltage of data to be written in each of the pixel regions of FIG. 2.
Figure 9:
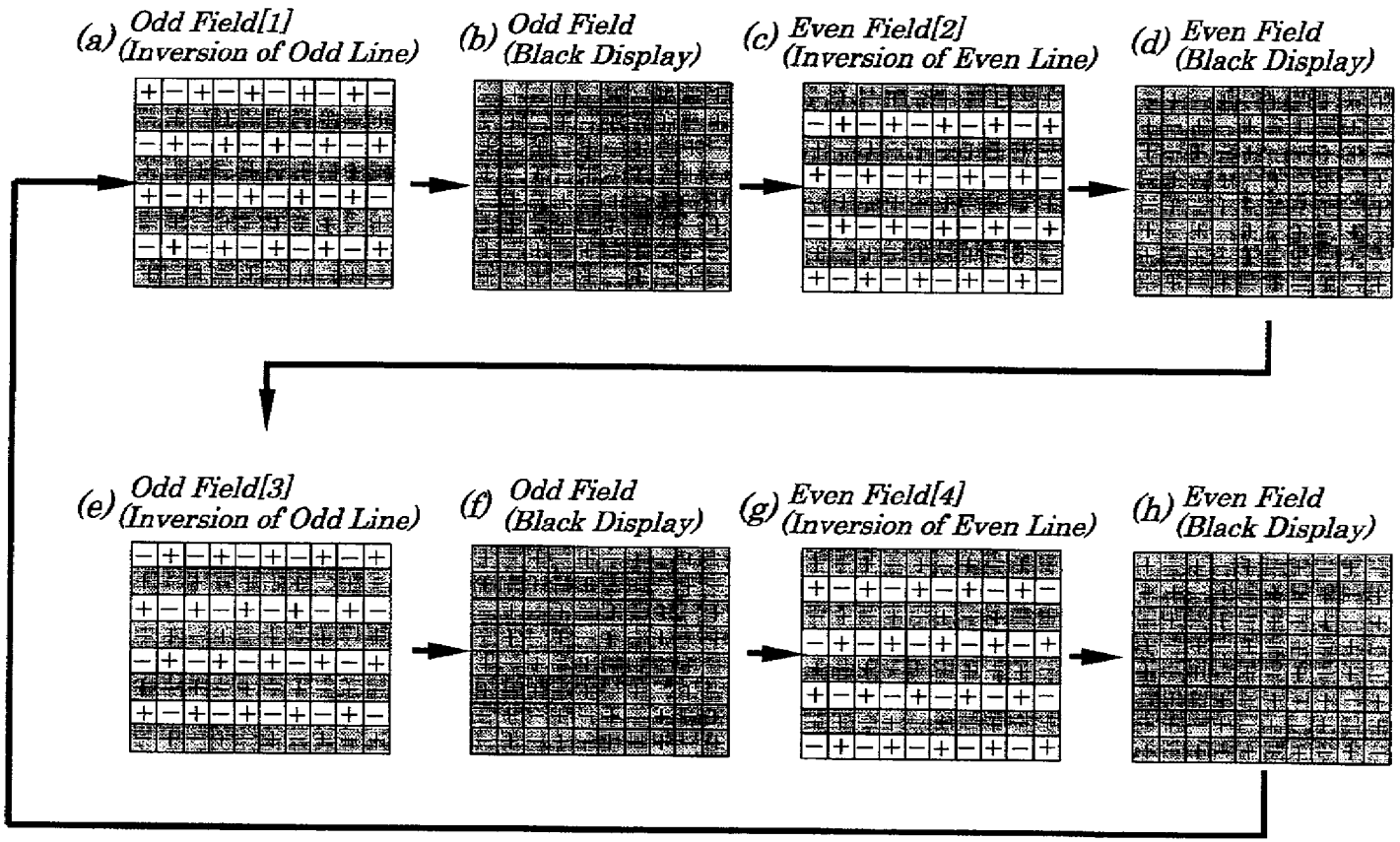
FIG. 9 is a diagram explaining yet another example of the inversion of a voltage of data to be written in each of the pixel regions of FIG. 2.
Figure 10:
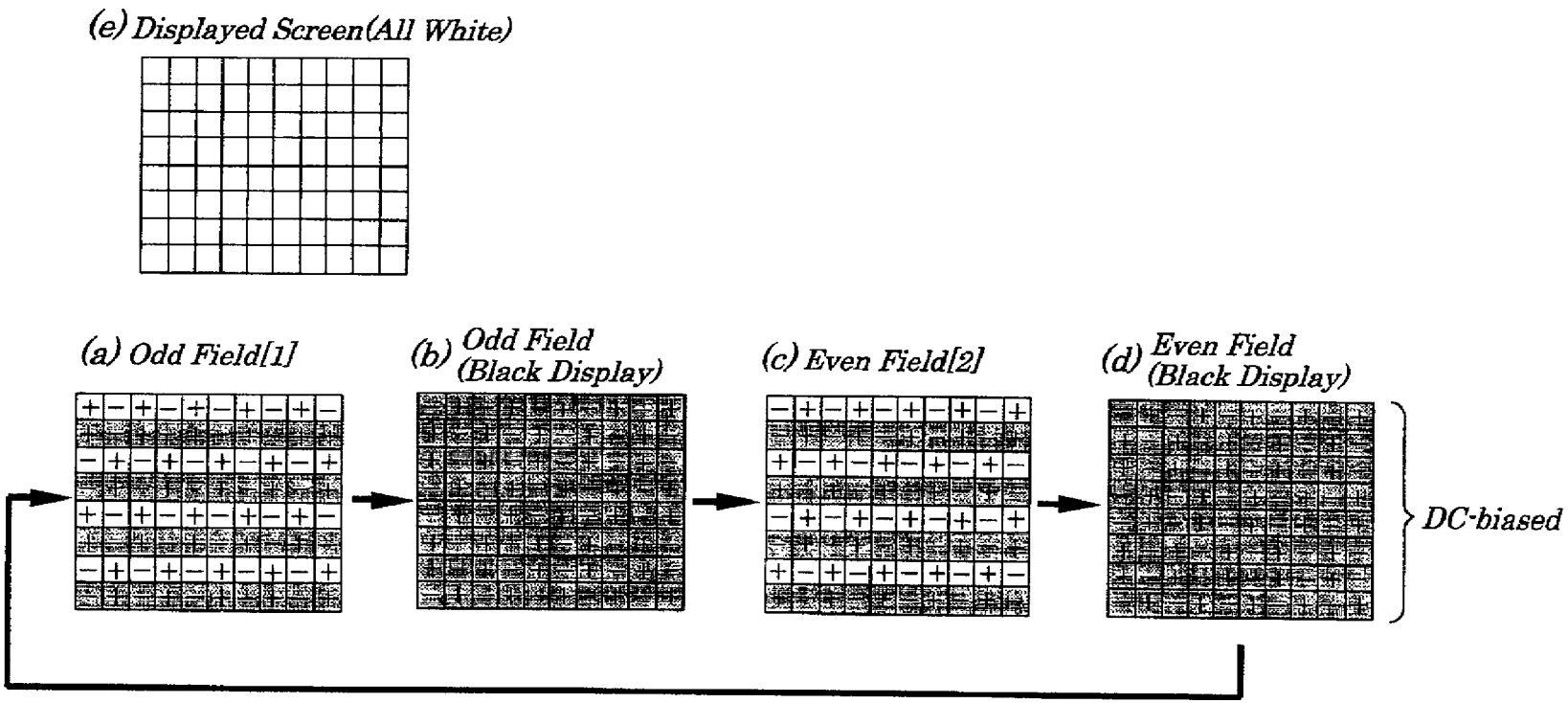
FIG. 10 is a diagram explaining an example of biasing of polarity of a voltage of data to be written in each of the pixel regions of FIG. 2.

Moreover, the polarity inversion driving method employed as the liquid crystal driving method for preventing a burn-in phenomenon according to the present invention includes also other methods shown in FIGS. 7, 8, and 9, in addition to the method shown in FIG. 5. In any one of these examples, the polarity of a voltage of data to be written in each of the pixel regions 20*i,j* corresponding to scanning electrodes Yj in odd-numbered rows is inverted in every odd field and the polarity of a voltage of data to be written in each of the pixel regions 20*i,j* corresponding to scanning electrodes Yj in even-numbered rows is inverted in every even field, thus preventing the voltage of display data Di in each of regions of the liquid crystal display panel from being biased and the above screen from being burnt in. In such methods as shown in FIGS. 10(*a*), (*b*), (*c*), and (*d*), in which the polarity of a voltage of data to be written in each of pixel regions 20*i,j* corresponding to the scanning electrodes Yj in odd-numbered rows is not inverted and the polarity of a voltage of data to be written in each of pixel regions 20*i,j* corresponding to the scanning electrodes Yj in even-numbered rows is not inverted, the polarity of a voltage of the data Di is biased on the liquid crystal display panel and, in the case of display of all white screens as shown in FIG. 10, burn-in occurs on all screens. This should be avoided. Moreover, the time during which black data is held as dark data is made longer and, therefore, even in the case of the IPS-type liquid in which the effect of inserting black is not fully exploited due to slow response speed from all white to all black, easy insertion of black can be achieved.

Second Embodiment

Figure 11:
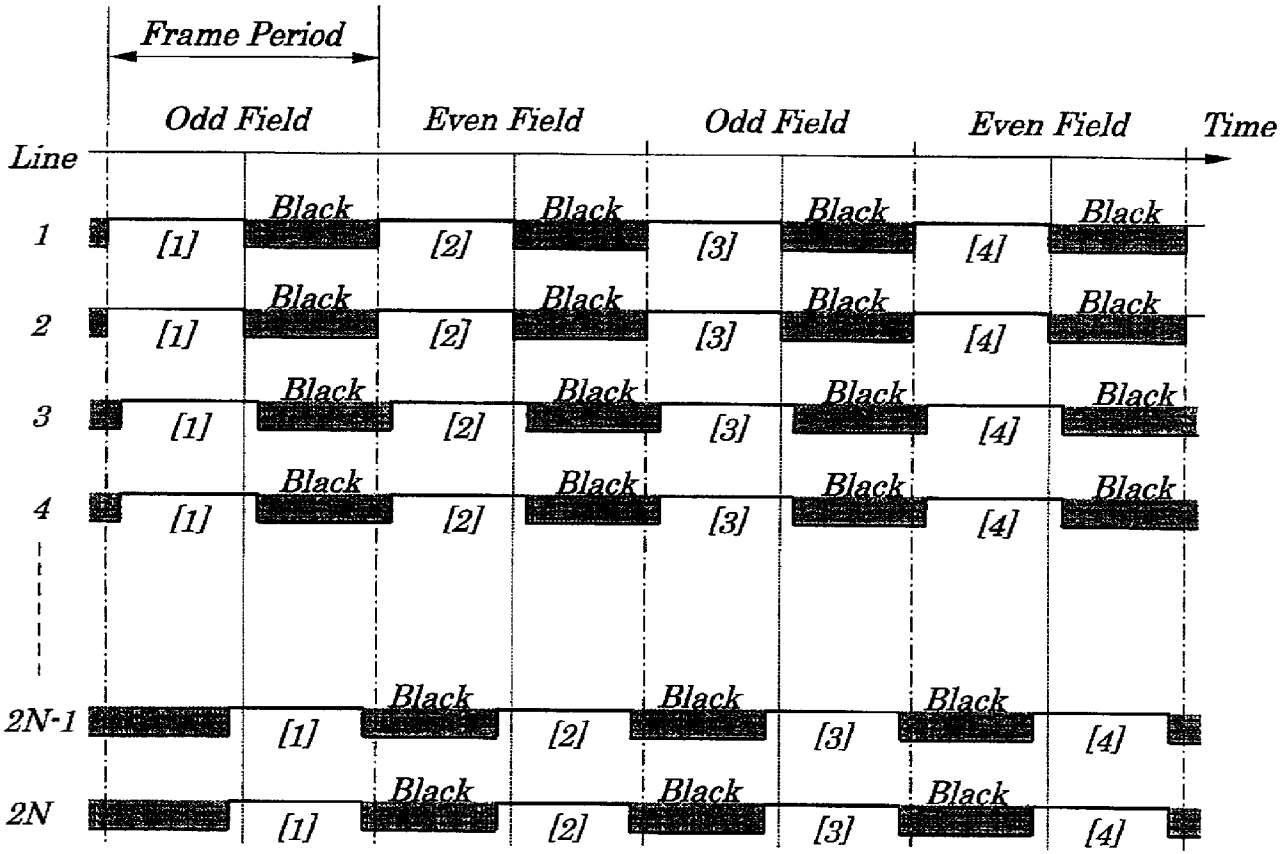
FIG. 11 is a time chart explaining operations of a liquid crystal display device according to a second embodiment of the present invention.
Figure 12:
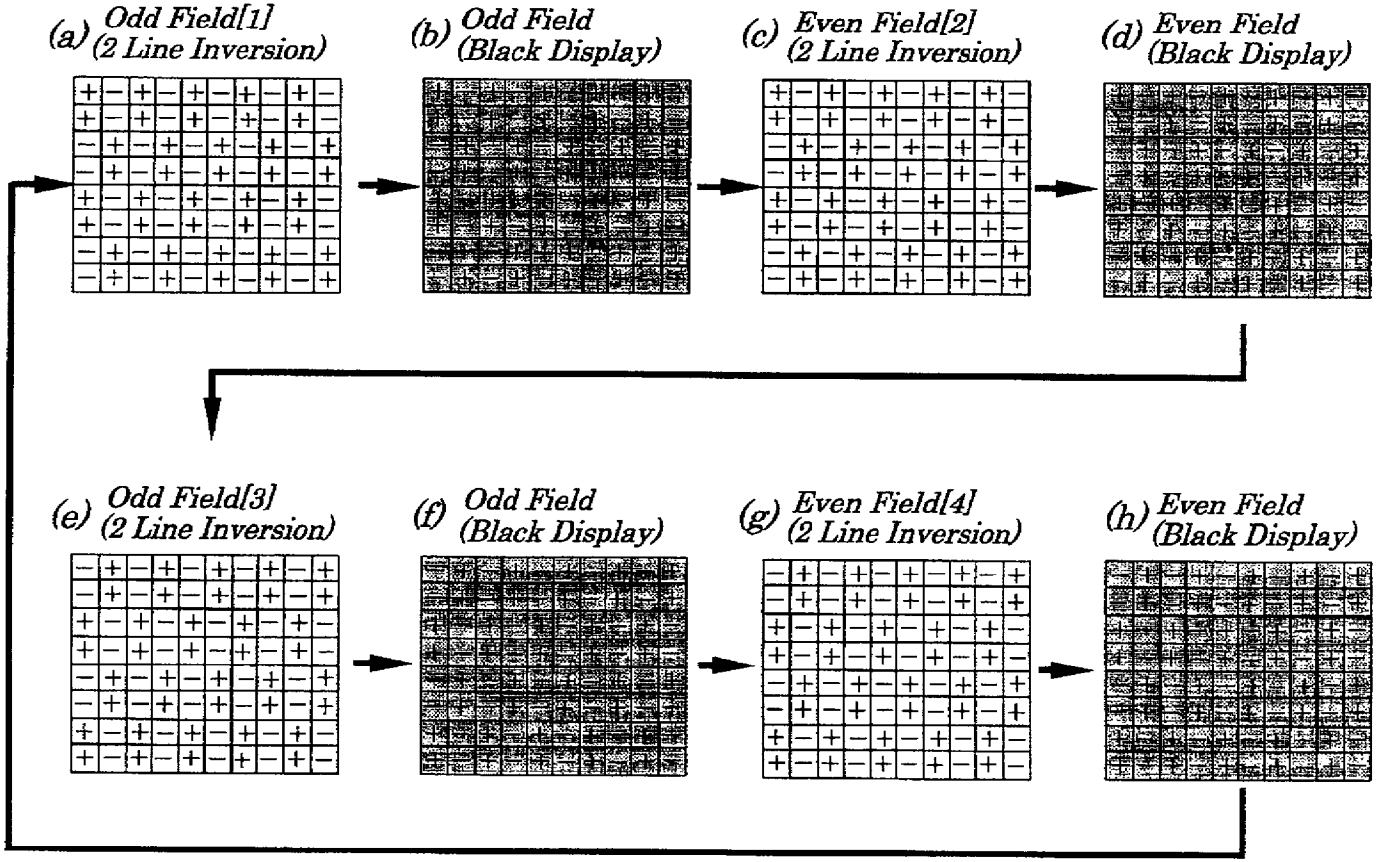
FIG. 12 is a diagram explaining an inversion of polarity of a voltage of data to be written in each of pixel regions according to the second embodiment.
Figure 13:
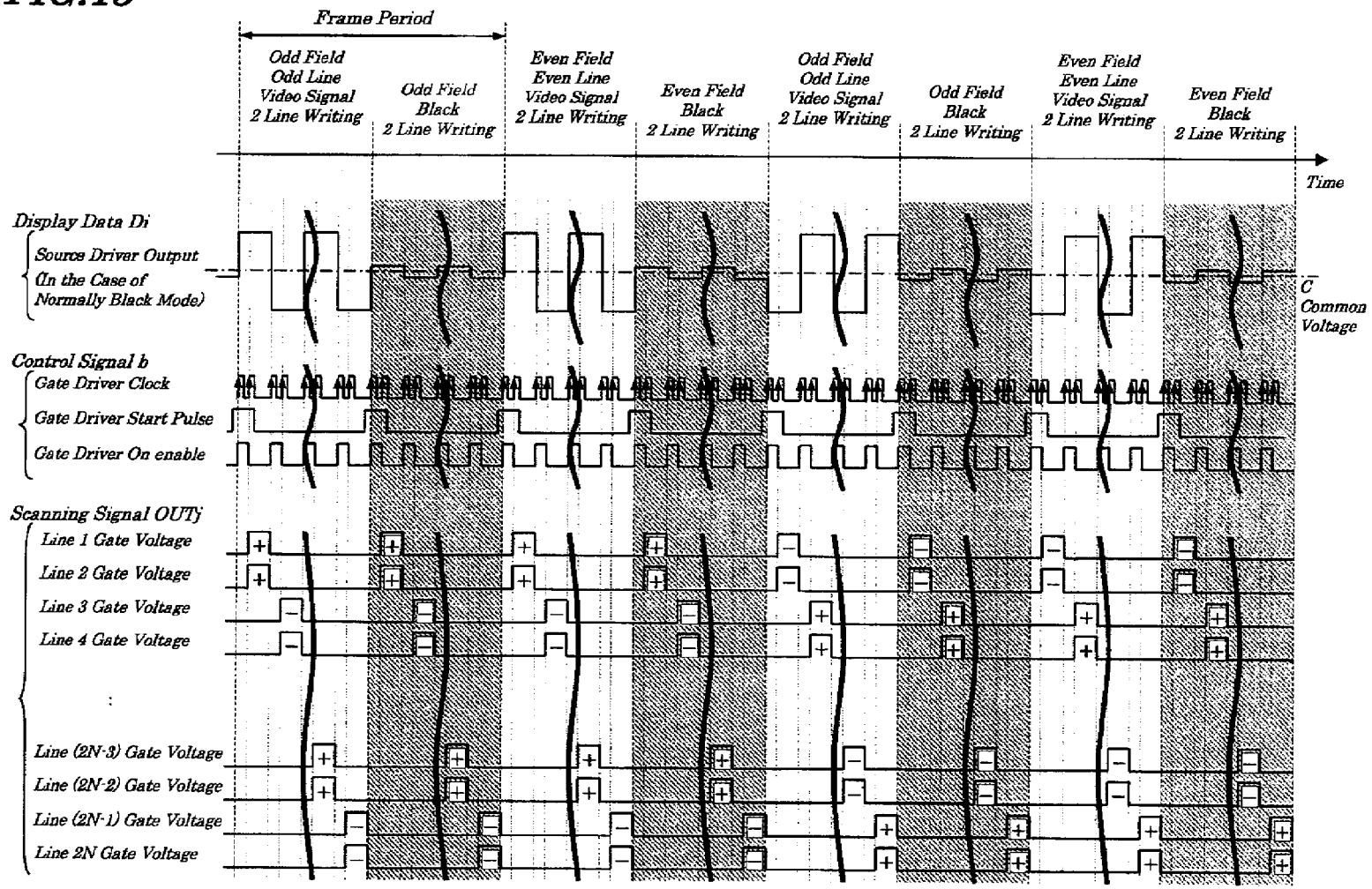
FIG. 13 is a waveform diagram explaining operations of the liquid crystal display device of the second embodiment of the present invention.
Figure 14:
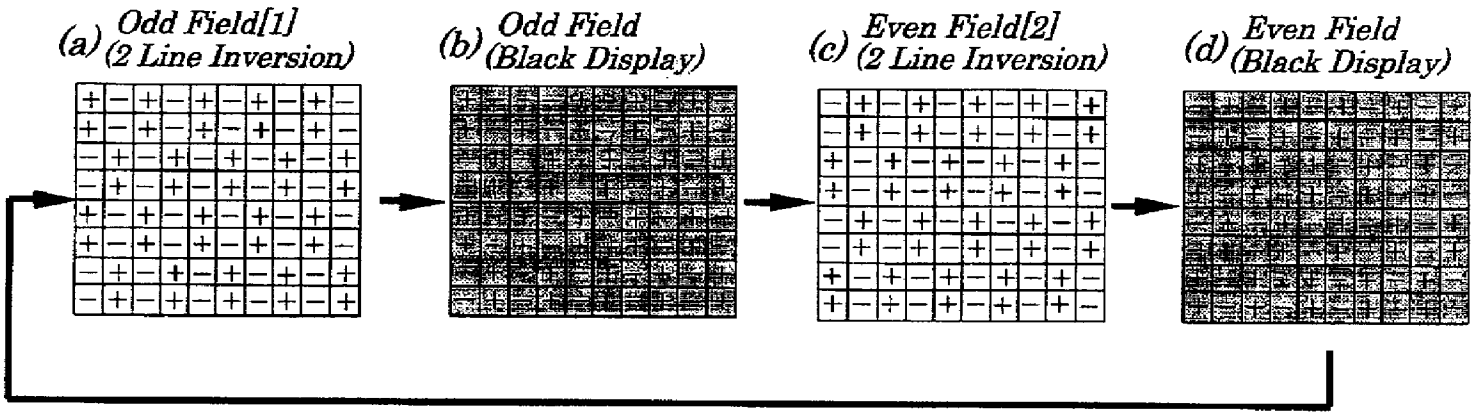
FIG. 14 is a diagram showing another example of the inversion of the polarity of a voltage of data to be written in each of the pixel regions according to the second embodiment of the present invention.
Figure 15:
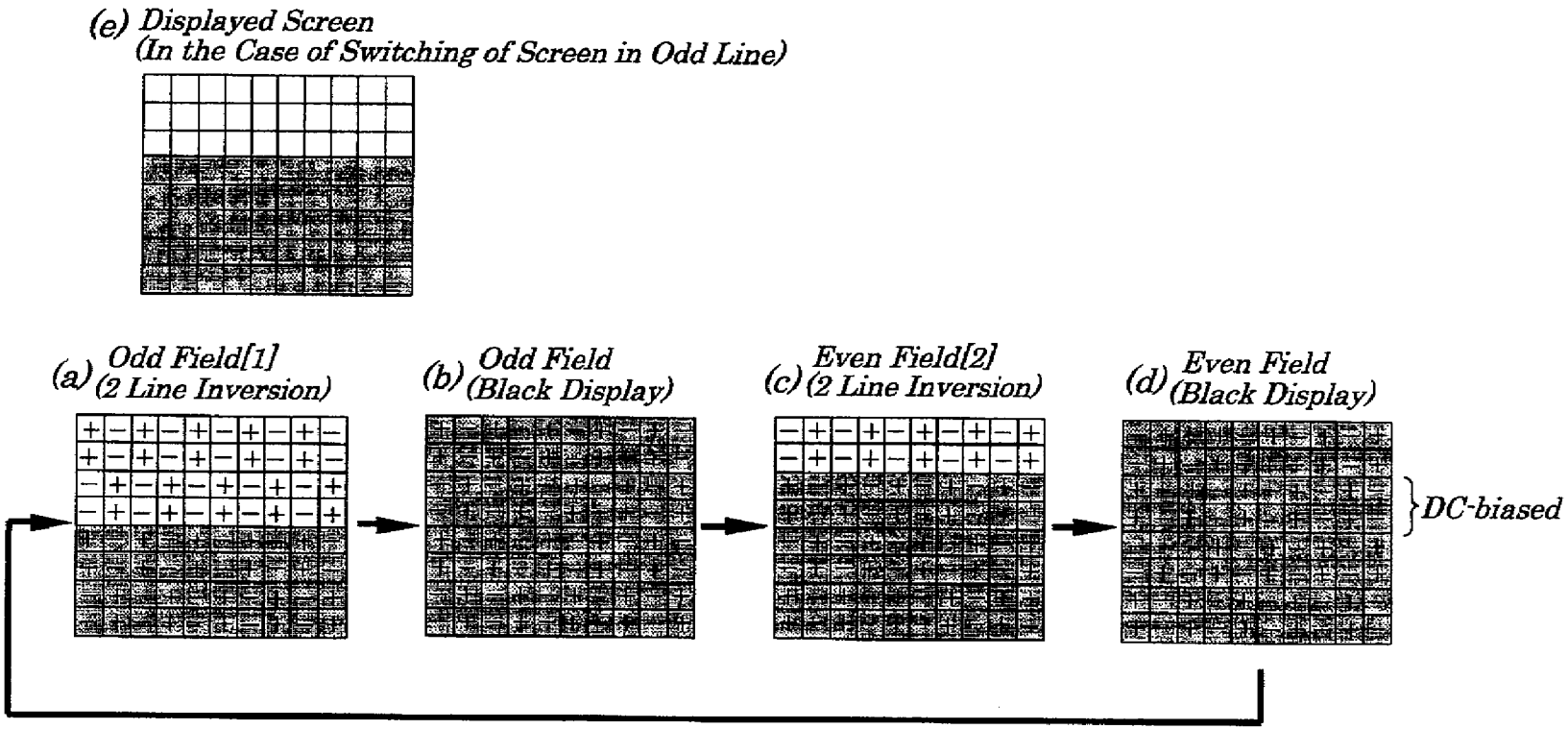
FIG. 15 is a diagram showing still another example of the inversion of the polarity of a voltage of data to be written in each of the pixel regions according to the second embodiment of the present invention.
Figure 16:
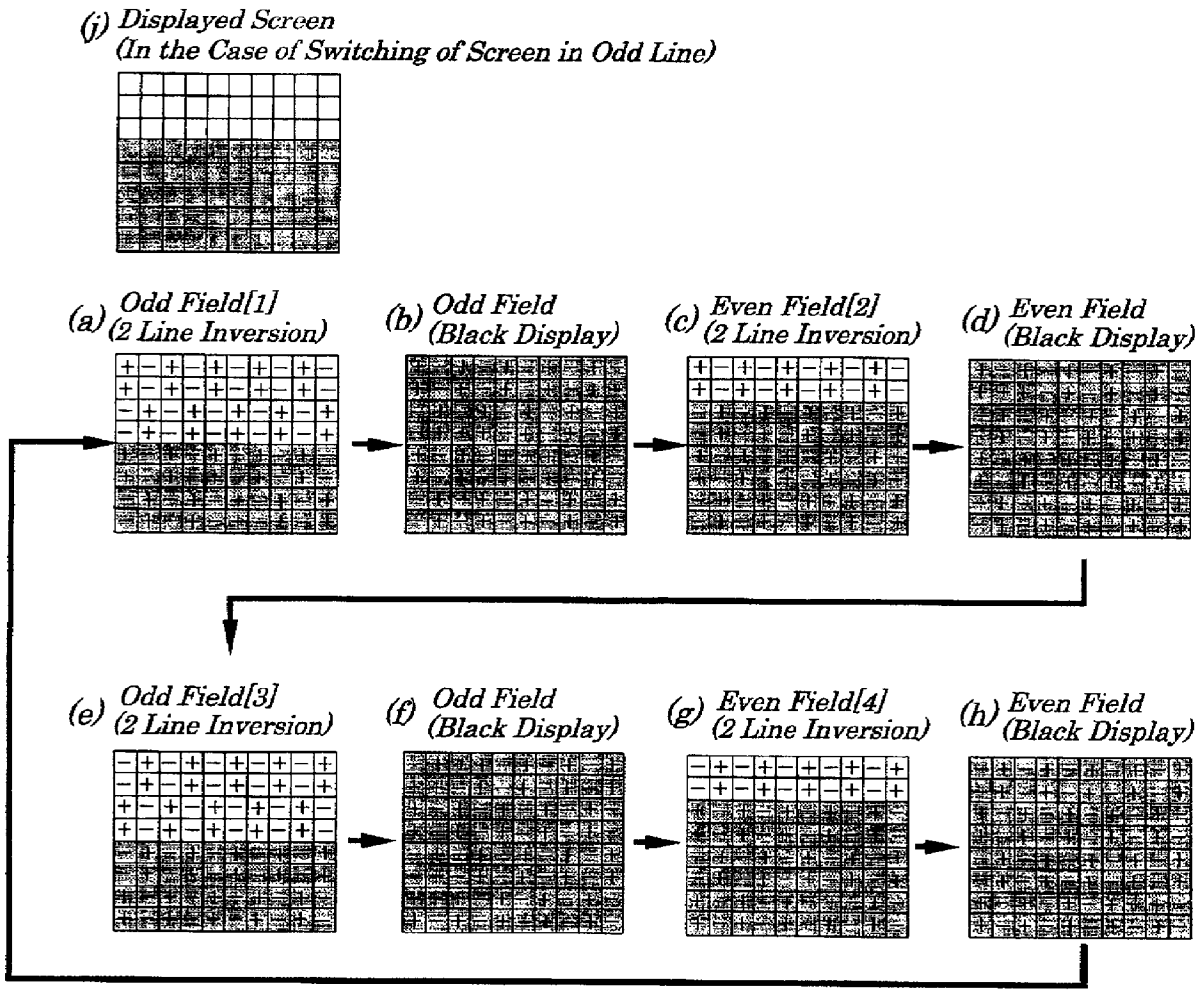
FIG. 16 is a diagram showing yet another example of the inversion of the polarity of a voltage of data to be written in each of the pixel regions according to the second embodiment of the present invention.

FIG. 11 is a time chart explaining operations of a liquid crystal display device according to a second embodiment of the present invention. FIG. 12 is a diagram explaining the inversion of the polarity of a voltage of data to be written in each of pixel regions of the second embodiment. FIG. 13 is a waveform diagram explaining operations of the liquid crystal display device of the second embodiment. FIG. 14 is a diagram showing another example of the inversion of the polarity of a voltage of data to be written in each of the pixel regions according to the second embodiment. FIG. 15 is a diagram showing still another example of the inversion of the polarity of a voltage of data to be written in each of the pixel regions according to the second embodiment. FIG. 16 is a diagram showing yet another example of the inversion of the polarity of a voltage of data to be written in each of the pixel regions of the second embodiment. Processing of the driving method employed in the liquid crystal display device of the second embodiment is explained by referring to these drawings. In the liquid crystal display device of the second embodiment, as shown in FIG. 11, in the former half of the odd field (during a period of the first odd sub-field), display data ([1], [3], . . . ) corresponding to an input video signal VD is line-sequentially written in each of pixel regions corresponding to scanning electrodes in odd-numbered rows and, at the same time, the display data ([1], [3], . . . ) is line-sequentially written also in each of pixel regions corresponding to each of the scanning electrodes in the next line (that is, in even-numbered row) of each of the scanning electrodes in odd-numbered rows and, in the latter half of the odd field (during a period of the second odd sub-field), black data is line-sequentially written in each of pixel regions corresponding to odd-numbered and even-numbered scanning electrodes.

Also, in the former half of the even field (during a period of the first even sub-field), display data ([2], [4], . . . ) corresponding to the input video signal VD is line-sequentially written in each of the pixel regions corresponding to the even-numbered rows and, at the same time, the display data ([2], [4], . . . ) is line-sequentially written also in each of pixel regions corresponding to each of the scanning electrodes in the previous line (that is, in odd-numbered row) of each of the scanning electrodes in even-numbered rows and, in the latter half of the even field (during a period of the second even sub-field), black data is line-sequentially written in each of pixel regions corresponding to even-numbered and odd-numbered scanning electrodes. Owing to these operations, in a state in which a frequency of a signal for display data Di, control signal "a", and scanning signal OUTj and time required for writing liquid crystal are the same as in the first embodiment, luminance efficiency of the liquid crystal display device is improved. In this case, for example, as shown in FIG. 12, the polarity of a voltage of data to be written in each of the pixel regions 20*i*, 20*j*+1 corresponding to scanning electrodes Yj and Yj+1 in every two odd-numbered lines and in every two even-numbered lines is inverted in every two odd fields and in every two even fields. As waveforms shown in FIG. 13 show, the same signals as have been already written in odd-numbered lines are simultaneously written in odd field and the same signals as have been already written in even-numbered lines are simultaneously written in even field. Operations other than described above are the same as those in FIG. 6.

As shown in FIGS. 14(*a*), (*b*), (*c*), and (*d*), in the method in which the polarity of a voltage of data to be written in pixel regions 20*j* and 20*j*+1 corresponding to every two scanning electrodes Yj and j+1 in every two odd-numbered row and in every two even-numbered rows is inverted in every odd field and in every even field, as shown in FIG. 15, when a screen is switched with an odd line as a border line, in the border line for switching the screen, a voltage of video data is written only in the odd field. That is, in this situation, there are lines in which a voltage of video data is written only on the same polarity and if this state continues long, a liquid crystal display panel burn-in unfavorably occurs in the border line between screens to be switched. Whereas, according to the inversion of the polarity in the embodiment shown in FIG. 12, as shown in FIG. 16 (*j*), the polarity of a voltage of data to be written in pixel regions 20*i*, and 20*j*+1 corresponding to scanning electrodes Yj and j+1 is inverted in every two lines in odd-numbered rows and in every two lines in even-numbered rows and, as a result, even in the border line between the screens to be switched, the polarity of a voltage of display data Di is not biased, causing no screen burn-in.

Third Embodiment

Figure 17:
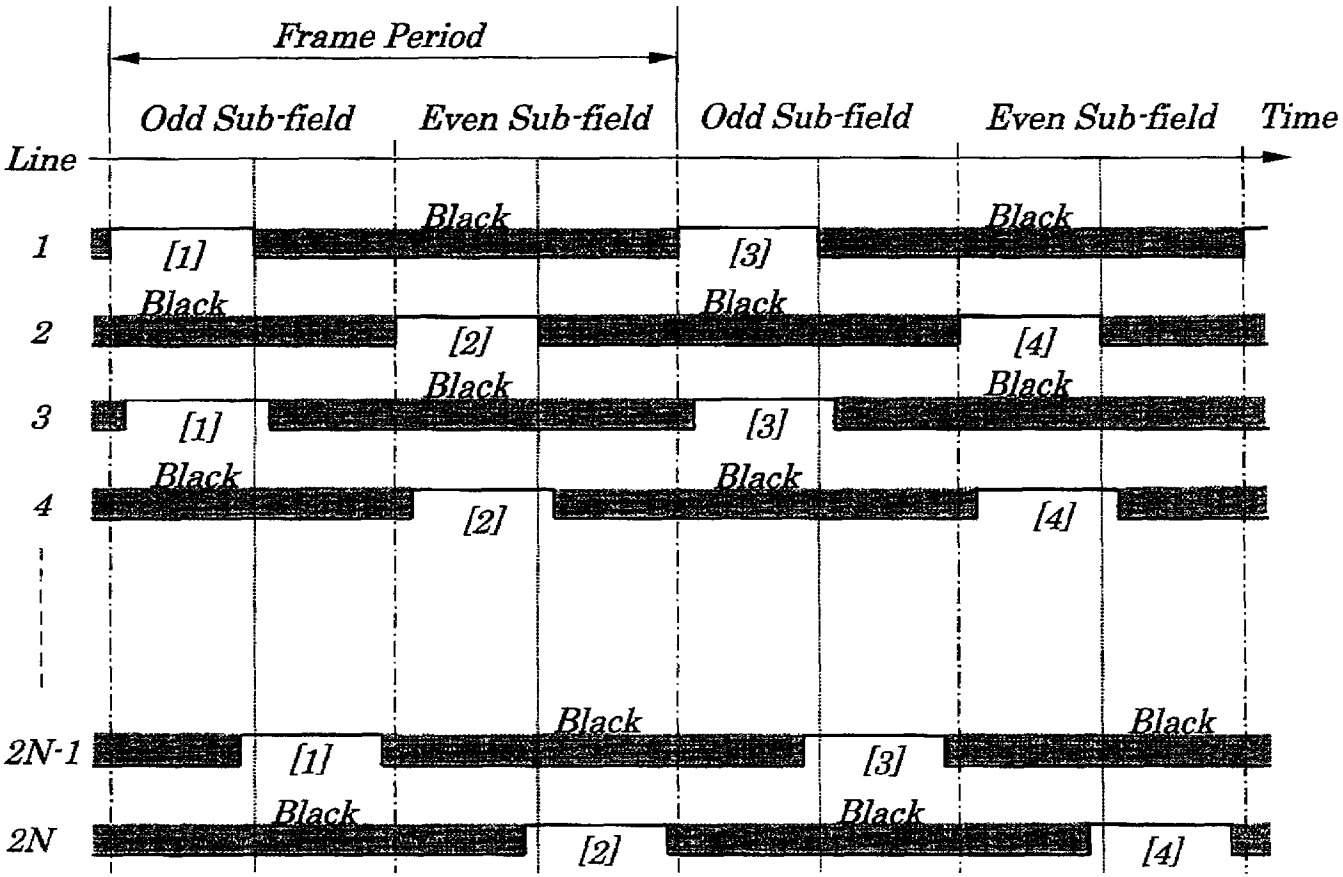
FIG. 17 is a time chart explaining a modified example of operations of a liquid crystal display according to a third embodiment of the present invention.
Figure 18:
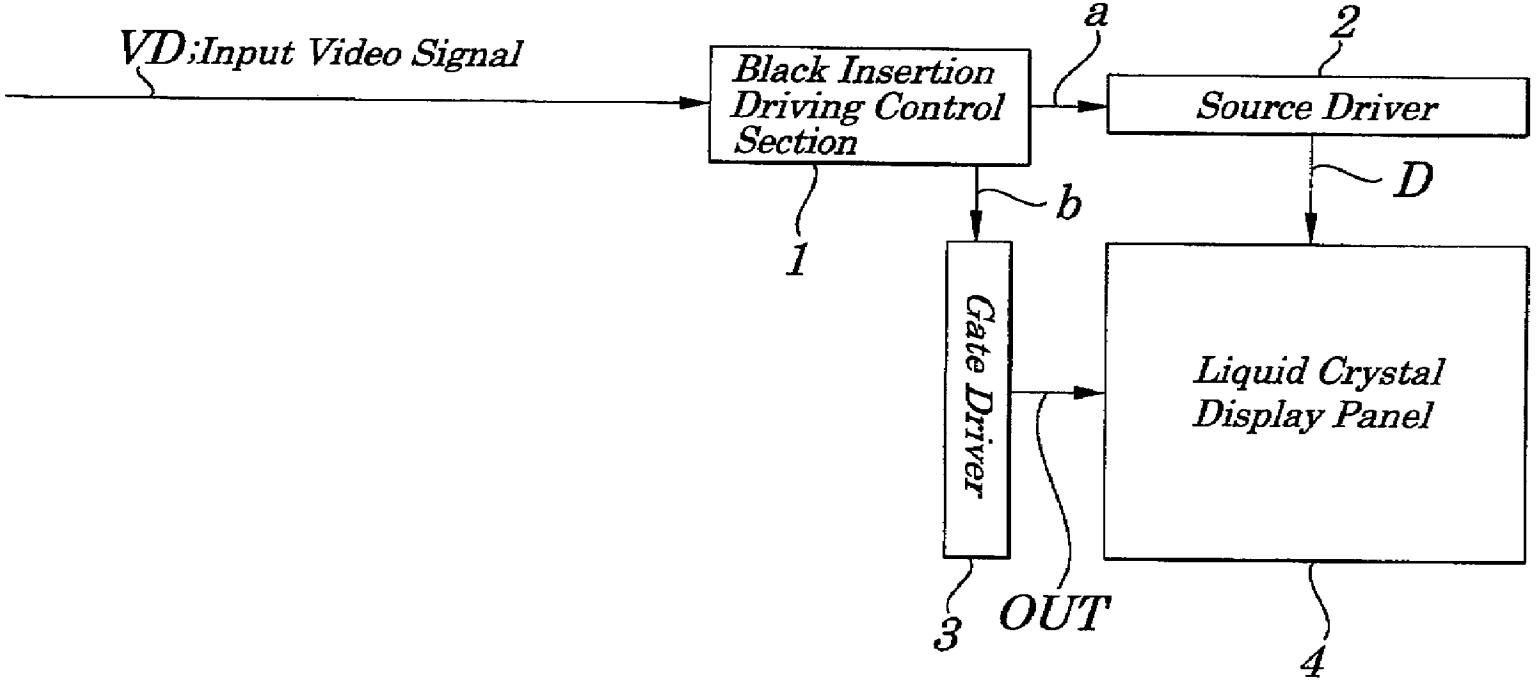
FIG.18 (RELATED ART)
FIG. 18 is a diagram showing electrical configurations of main components of a conventional liquid crystal display device.
Figure 19:
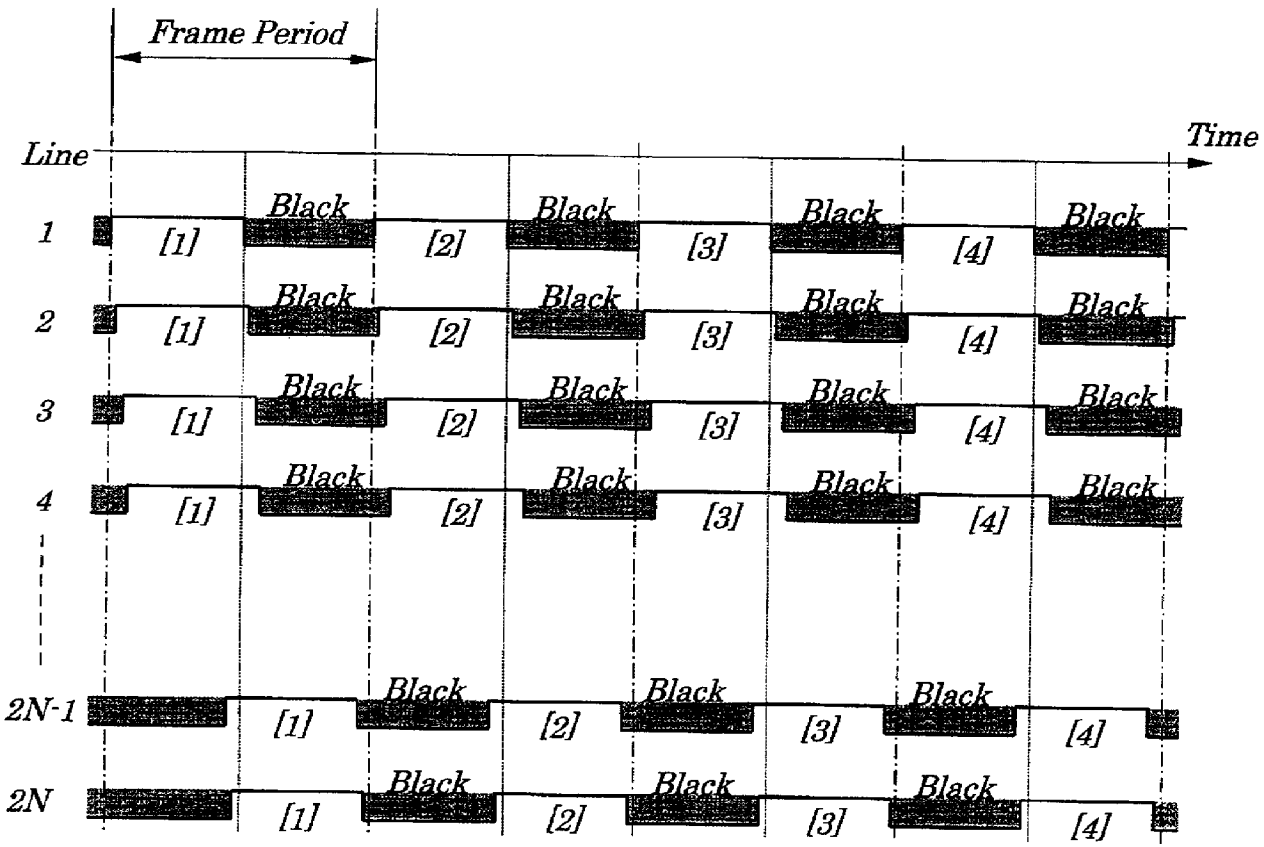
FIG. 19 (RELATED ART)
FIG. 19 is a time chart explaining operations of the conventional liquid crystal display device of FIG. 18.
Figure 20:
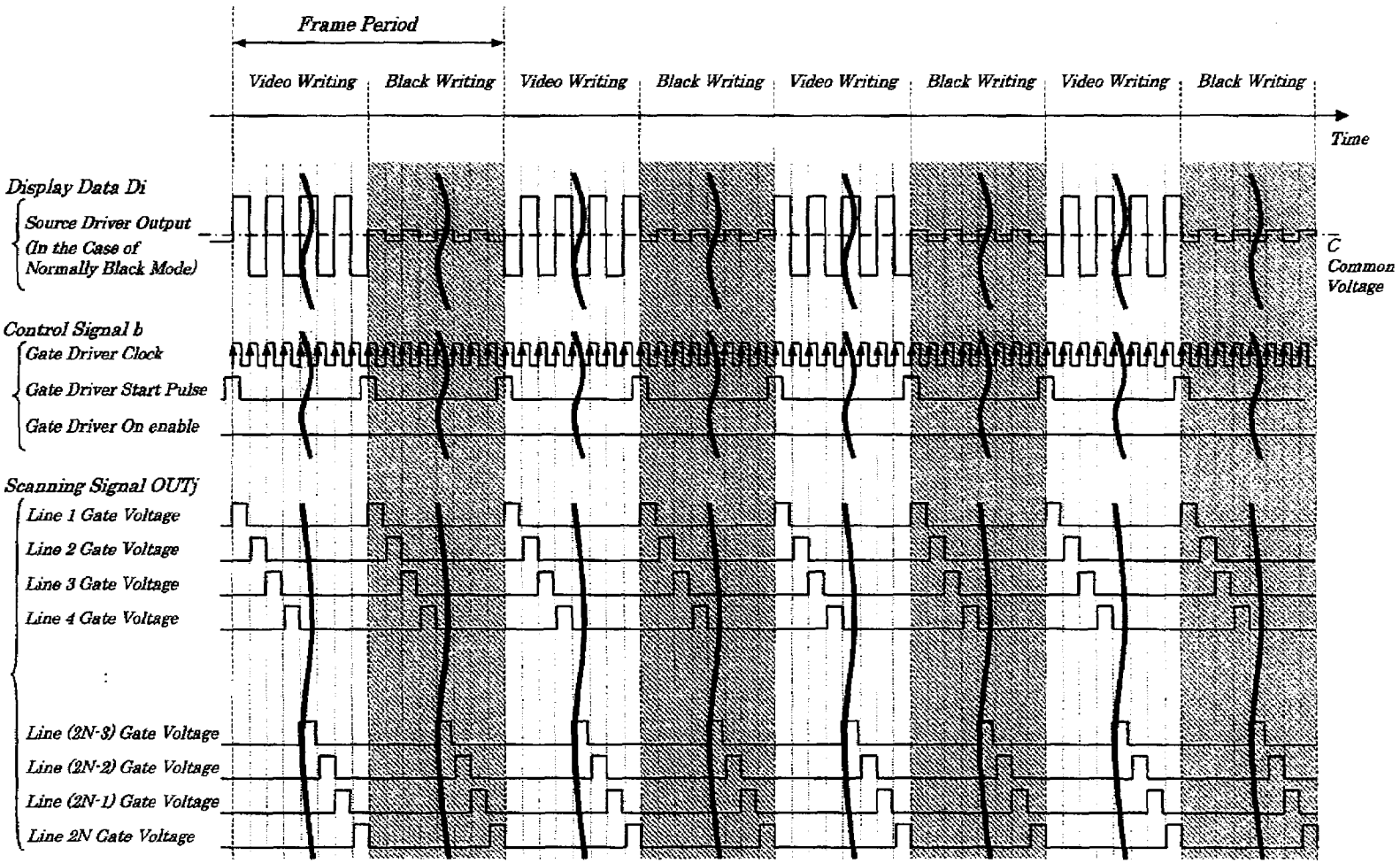
FIG.20 (RELATED ART)
FIG. 20 is also a time chart explaining operations of the conventional liquid crystal display device of FIG. 18.
Figure 21:
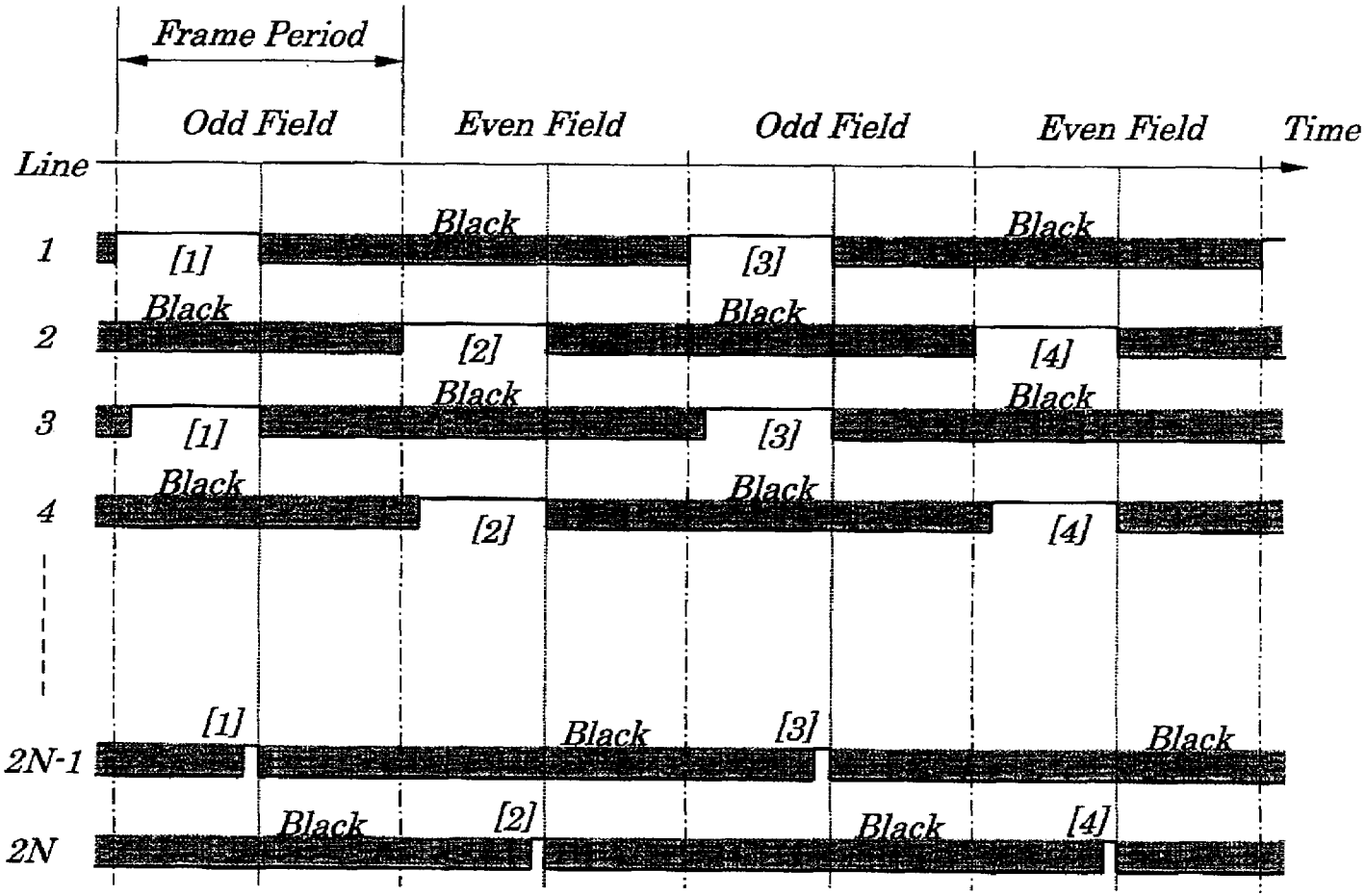
FIG.21 (RELATED ART)
FIG. 21 is a diagram of a waveform of a signal of each component explaining operations of the conventional liquid crystal display device.

FIG. 17 is a time chart explaining a modified example of operations of the liquid crystal display according to a third embodiment of the present invention. The liquid crystal display device of the first embodiment is driven at a frequency being a half the frequency at which black is inserted ordinarily. In the third embodiment, in the case where the liquid crystal display panel and each component are driven at a doubled speed, one frame is divided into four fields and, by setting the frequency for switching between the odd and even field at a frequency being twice higher than a frame frequency, a doubled increase in frequency caused by an increased frame frequency can be offset by the by-half decrease in frequency achieved by the driving method of the present invention. Therefore, at an operational frequency of a signal of each component being the same as the conventional frequency for black insertion driving, a flashing frequency for black display and video display can be doubled, which enables the provision of the liquid crystal display device capable of reducing blurring of moving images and removing flickering caused by black insertion and the driving control circuit and driving method employed in the liquid crystal display device. Moreover, the frame frequency of the liquid crystal display shown in FIG. 7 is made higher than that of the liquid crystal display shown in FIG. 1. The same effects can be also obtained by making the frame frequency shown in the second embodiment higher.

It is apparent that the present invention is not limited to the above embodiments but may be changed and modified without departing from the scope and spirit of the invention. For example, even if an input video signal VD is received by an interlaced driving method or by a progressive driving method, by converting the input video signal VD using the timing controller 11, the same effects as obtained in the first, second, and third embodiments can be also achieved. Alternatively, the gate driver 13 shown in FIG. 1 may be configured to be divided into two types, one to apply a scanning signal OUTj to each of scanning electrodes Yj in odd-numbered rows in the liquid crystal display panel and the other to apply a scanning signal OUTj to each of scanning electrodes Yj in even-numbered rows. If so, the timing controller 11 needs to be so configured as to match the type having the above structure. The liquid crystal display panel 14 shown in FIG. 1 is not limited to the liquid crystal display panel having the configurations shown in FIGS. 2 and 3 and TN (Twisted Nematic)-type liquid crystal and/or VA (Vertical Alignment)-type liquid crystal display panel may be used as well.

In the above embodiments, black data is used as dark data. The present invention is not limited to the black data. Even when data having gray levels being similar to the black data, the same actions and effects as obtained in the above embodiment can be achieved. The polarity of a voltage of data to be written in pixel regions is not limited to that shown in FIG. 5. Moreover, as shown in the time chart of FIG. 6 or FIG. 13, the waveform of a signal for the display data Di corresponds to the case when the liquid crystal display panel 14 is of a normally black type, however, a normally white type liquid crystal display panel can be employed.

Additionally, the present invention can be applied generally to liquid crystal display devices to display moving images such as a liquid crystal monitor.

What is claimed is:

1. A liquid crystal display device for obtaining displayed images by driving a plurality of rows of scanning electrodes and a plurality of columns of data electrodes, both being arranged to be orthogonal to one another, according to an input video signal so that specified display data is written in each pixel region corresponding to a liquid crystal layer, comprising:

a driving control circuit to perform a field dividing driving operation by which an odd field period, during which each of scanning electrodes in odd-numbered rows is sequentially driven while skipping over scanning electrodes in all even-numbered rows, and an even field period, during which each of scanning electrodes in even-numbered rows is sequentially driven while skipping over scanning electrodes in all odd-numbered rows, occur alternately and repeatedly in every display frame period, the driving control circuit comprising:

a frame memory which stores sequentially the input video signal, a black signal converting unit which divides the odd field period into a first half comprising a first odd sub-field which outputs display data corresponding to the odd-numbered rows of the input video signal and into a second half comprising a second odd sub-field which outputs dark data, and divides the even field period into a first half comprising a first even sub-field which outputs display data corresponding to the even-numbered rows of the input video signal and into a second half comprising a second even sub-field which outputs the dark data, by using the input video signal fed from the frame memory, and a driving control unit, which writes line-sequentially the display data fed from said black signal converting unit in the odd-numbered rows of pixel regions during said first odd sub-field, and writes line-sequentially the dark data fed from said black signal converting unit in the odd-numbered rows of pixel regions during said second odd sub-field, by driving said scanning electrodes in the odd-numbered rows during the odd field period, writes line-sequentially the display data fed from said black signal converting unit in the even-numbered rows of pixel regions during said first even sub-field, and writes line-sequentially the dark data fed from said black signal converting unit in the even-numbered rows of pixel regions during said second even sub-field, by driving said scanning electrodes in the even-numbered rows during the even field period, and inverts a polarity of voltage of the display data to be written in the pixel regions corresponding to each of said scanning electrodes in every two fields, repeatedly for every four fields as a whole.

2. The liquid crystal display device according to claim 1, wherein the polarity of voltage of the display data to be written in said pixel regions corresponding to each of said scanning electrodes in the odd-numbered rows is inverted in every odd field period and the polarity of voltage of the display data to be written in said pixel regions corresponding to each of said scanning electrodes in the even-numbered rows is inverted in every even field period.

3. The liquid crystal display device according to claim 1, wherein said dark data is black data.

4. The liquid crystal display device according to claim 1, wherein, during said odd field period, each of said scanning electrodes in the odd-numbered rows is successively driven and, simultaneously, each of said scanning electrodes in the even-numbered rows existing next to each of the scanning electrodes in said odd-numbered rows is driven and wherein, during said even field period, each of said scanning electrodes in the even-numbered rows is successively driven and, simultaneously, each of said scanning electrodes in the odd-numbered rows existing before each of said scanning electrodes in said even-numbered rows is successively driven.

5. The liquid crystal display device according to claim 1, wherein said liquid crystal layer comprises an In-Plane Switching (IPS) type liquid crystal.

6. A driving control circuit for a liquid crystal display device for obtaining displayed images by driving a plurality of rows of scanning electrodes and a plurality of columns of data electrodes, both being arranged to be orthogonal to one another, according to an input video signal so that specified display data is written in each pixel region corresponding to a liquid crystal layer, the driving control circuit configured:

to perform a field dividing driving operation by which an odd field period, during which each of scanning electrodes in odd-numbered rows is sequentially driven while skipping over scanning electrodes in all even-numbered rows, and an even field period, during which each of scanning electrodes in even-numbered rows is sequentially driven while skipping over scanning electrodes in all odd-numbered rows, occur alternately and repeatedly in every display frame period, the driving control circuit comprising:

a frame memory which stores sequentially the input video signal, a black signal converting unit which divides the odd field period into a first half comprising a first odd sub-field which outputs display data corresponding to the odd-numbered rows of the input video signal and into a second half comprising a second odd sub-field which outputs dark data, and divides the even field period into a first half comprising a first even sub-field which outputs display data corresponding to the even-numbered rows of the input video signal and a second half comprising a second even sub-field which outputs the dark data, by using the input video signal fed from the frame memory, and a driving control unit which writes line-sequentially the display data fed from the black signal converting unit in the odd-numbered rows of pixel regions during the first odd sub-field, and writes line-sequentially the dark data fed from the black signal converting unit in the odd-numbered rows of pixel regions during the second odd sub-field, by driving the scanning electrodes in the odd-numbered rows during the odd field period, writes line-sequentially the display data fed from the black signal converting unit in the even-numbered rows of pixel regions during the first even sub-field, and writes line-sequentially the dark data fed from the black signal converting unit in the even-numbered rows of pixel regions during the second even sub-field, by driving the scanning electrodes in the even-numbered rows during the even field period, and inverts a polarity of voltage of the display data to be written in the pixel regions corresponding to each of said scanning electrodes in every two fields repeatedly for every four fields as a whole.

7. The driving control circuit according to claim 6, wherein the polarity of voltage of the display data to be written in said pixel regions corresponding to each of said scanning electrodes in the odd-numbered rows is inverted in every odd field period and the polarity of voltage of the display data to be written in the pixel regions corresponding to each of said scanning electrodes in the even-numbered rows is inverted in every even field period.

8. The driving control circuit according to claim 6, wherein said dark data is black data.

9. The driving control circuit according to claim 6, wherein, during said odd field period, each of said scanning electrodes in the odd-numbered rows is successively driven and, simultaneously, each of said scanning electrodes in the even-numbered rows existing next to each of the scanning electrodes in said odd-numbered rows is driven and wherein, during said even field period, each of said scanning electrodes in the even-numbered rows is successively driven and, simultaneously, each of said scanning electrodes in the odd-numbered rows existing before each of the scanning electrodes in said even-numbered rows is successively driven.

10. The driving control circuit according to claim 6, wherein said liquid crystal layer comprises an In-Plane Switching (IPS) type liquid crystal.

11. A driving method for a liquid crystal display device for obtaining displayed images by driving a plurality of rows of scanning electrodes and a plurality of columns of data electrodes, both being arranged to be orthogonal to one another, according to an input video signal so that specified display data is written in each pixel region corresponding to a liquid crystal layer, comprising:

performing a field dividing driving operation by which an odd field period, during which each of scanning electrodes in odd-numbered rows is sequentially driven while skipping over scanning electrodes in all even-numbered rows, and an even field period, during which each of scanning electrodes in even-numbered rows is sequentially driven while skipping over scanning electrodes in all odd-numbered rows, occur alternately and repeatedly in every display frame period, wherein the performing the field dividing driving operation comprises:

storing sequentially said input video signal;

dividing said odd field period into a first half comprising a first odd sub-field which outputs display data corresponding to the odd-numbered rows of said input video signal and a second half comprising a second old sub-field which outputs dark data, and dividing said even field period into a first half comprising a first even sub-field which outputs display data corresponding to the even-numbered rows of said input video signal, and a second half comprising a second even sub-field which outputs the dark data, by using said input video signal sequentially stored;

writing line-sequentially the display data in the odd-numbered rows of pixel regions during said first odd sub-field, and writes line-sequentially the dark data in the odd-numbered rows of pixel regions during said second odd sub-field, by driving said scanning electrodes in the odd-numbered rows during the odd field period;

writing line-sequentially the display data in the even-numbered rows of pixel regions during said first even sub-field, and writes line-sequentially the dark data in the even-numbered rows of pixel regions during said second even sub-field, by driving said scanning electrodes in the even-numbered rows during the even field period; and inverting a polarity of voltage of the display data to be written in the pixel regions corresponding to each of said scanning electrodes in every two fields repeatedly for every four fields as a whole.

12. The driving method according to claim 11, wherein the polarity of voltage of the display data to be written in said pixel regions corresponding to each of said scanning electrodes in the odd-numbered rows is inverted in every odd field period and the polarity of voltage of the display data to be written in said pixel regions corresponding to each of said scanning electrodes in the even-numbered rows is inverted in every even field period.

13. The driving method according to claim 11, wherein said dark data is black data.

14. The driving method according to claim 11, wherein, during said odd field period, each of said scanning electrodes in the odd-numbered rows is successively driven and, simultaneously, each of said scanning electrodes in the even-numbered rows existing next to each of the scanning electrodes in said odd-numbered rows is driven and wherein, during said even field period, each of said scanning electrodes in the even-numbered rows is successively driven and, simultaneously, each of said scanning electrodes in the odd-numbered rows existing before each of the scanning electrodes in said even-numbered rows is successively driven.

15. The driving method according to claim 11, wherein said liquid crystal layer comprises an In-Plane Switching (IPS) type liquid crystal.

* * * * *